US005142255A

United States Patent [19]

Chang et al.

[11] Patent Number: 5,142,255

[45] Date of Patent: Aug. 25, 1992

[54] PLANAR ACTIVE ENDFIRE RADIATING ELEMENTS AND COPLANAR WAVEGUIDE FILTERS WITH WIDE ELECTRONIC TUNING BANDWIDTH

[75] Inventors: Kai Chang, College Station; Julio A. Navarro, Pasadena; Yong H. Shu, Bryan, all of Tex.

[73] Assignee: The Texas A&M University System, College Station, Tex.

[21] Appl. No.: 521,711

[22] Filed: May 7, 1990

[51] Int. Cl.[5] ..... H01P 3/08; H01P 1/203

[52] U.S. Cl. ..... 333/204; 333/219; 333/246; 343/767

[58] Field of Search ..... 333/26, 33, 204, 205, 333/219, 246, 247; 455/326-328; 343/700 MS, 767, 768

[56] References Cited

U.S. PATENT DOCUMENTS

| | | | |
|---|---|---|---|
| 3,566,312 | 2/1971 | McDonald | 333/174 |
| 3,593,225 | 7/1971 | Fisher | 333/205 |
| 3,714,659 | 1/1973 | Firman | 343/701 |
| 3,729,688 | 4/1973 | Cerny, Jr. et al. | 331/1A |
| 3,750,057 | 7/1973 | Smith | 333/174 |
| 3,760,301 | 9/1973 | Goransson et al. | 333/174 |
| 3,760,304 | 9/1973 | Cohn | 333/219 X |
| 3,803,429 | 4/1974 | Wieczorek et al. | 307/304 |
| 3,866,232 | 2/1975 | Weigt | 343/713 |
| 3,939,423 | 2/1976 | Zakharov et al. | 325/312 |
| 4,032,849 | 6/1977 | Gysel et al. | 455/327 |
| 4,197,546 | 4/1980 | Cachier et al. | 343/701 |
| 4,205,277 | 5/1980 | Poinas | 331/12 |
| 4,385,402 | 5/1983 | Barrs | 455/339 |
| 4,435,841 | 3/1984 | Dobrovolny | 455/180 |
| 4,436,956 | 3/1984 | Schreiber | 179/2 C |
| 4,459,566 | 7/1984 | Lane | 331/135 |
| 4,639,093 | 1/1987 | Kubick | 350/388 |
| 4,642,584 | 2/1987 | Funck et al. | 333/247 X |
| 4,662,001 | 4/1987 | Cruz et al. | 445/340 |
| 4,724,407 | 2/1988 | Miura et al. | 333/17 R |
| 4,736,454 | 4/1988 | Hirsch | 455/129 |
| 4,757,287 | 7/1988 | Grandfield | 333/205 |
| 4,791,426 | 12/1988 | Lindenmeier | 343/713 |
| 4,799,034 | 1/1989 | Silverman et al. | 333/202 |
| 4,823,136 | 4/1989 | Nathanson et al. | 342/368 |
| 4,835,499 | 5/1989 | Pickett | 333/205 |
| 4,843,403 | 6/1989 | Lalezari et al. | 343/700 MS X |
| 4,893,126 | 1/1990 | Evans | 343/700 MS X |

FOREIGN PATENT DOCUMENTS

| | | | |
|---|---|---|---|
| 1493381 | 11/1977 | United Kingdom | 333/204 |

OTHER PUBLICATIONS

J. S., "Wide-Band Varactor-Tuned X-Band Gunn Oscillators in Full-Height Waveguide Cavity," IEEE Transactions on Microwave Theory and Techniques, vol. MTT-21, No. 3, pp. 137-139, Mar. 1973.

J. B. Knorr, "Slot-Line Transitions," IEEE Transac- (List continued on next page.)

*Primary Examiner*—Eugene R. LaRoche
*Assistant Examiner*—Seung Ham
*Attorney, Agent, or Firm*—Arnold, White & Durkee

[57] ABSTRACT

Microwave and millmeter-wave system components are fabricated by using slotlines extending from the periphery of CPW resonators. This technique permits the degree of electrical coupling between the CPW and and the slotlines to be adjusted for matching, and the CPW resonators and slotlines behave as if they were relatively independent circuit elements, permitting transmission line models to be useful design tools and predicting the behavior of the system components. The system components are fully planar and allow easy integration of active and passive semiconductor devices in series with the CPW, and in shunt across the slotlines in hybrid and monolithic circuit forms. This technique also enables the conductive plane to be split for biasing semiconductor devices coupled to the CPW resonators for microwave and millimeter-wave power generation, tuning, mixing, filtering, frequency multiplication and switching. Integration with a notch antenna and slot-to-microstrip transitions are also described which permit a direct radiation/reception or a coaxial connector output.

22 Claims, 26 Drawing Sheets

OTHER PUBLICATIONS tions on Microwave Theory and Techniques, vol. MTT-22, pp. 548-554, May 1974.

J. B. Knorr and K. Kuchler, "Analysis of Coupled Slots and Coplanar Strips on Dielectric Substrates," IEEE Microwave Theory and Techniques, vol. MTT-23, pp. 541-548, Jul. 1975.

T. Hatsuda, "Computation of Coplanar-type Stripline Characteristics by Relaxation Method and its Application to Microwave Circuits," IEEE Microwave Theory and Techniques, vol. MTT-23, No. 10, pp. 795-802, Oct. 1975.

D. Rubin, "Varactor-Tuned Millimeter-Wave MIC Oscillator," IEEE Transactions on Microwave Theory and Techniques, vol. MTT-24, No. 11, pp. 866-867, Nov. 1976.

R. Garg and K. C. Gupta, "Expressions for Wavelength and Impedance of a Slotline," IEEE Microwave Theory and Techniques, vol. MTT-24, pp. 532, 1976.

K. C. Gupta et al., *Mictostrip Line and Slotlines*, Artech House, Dedham, MA, pp. 231-255, 289-301, 1979.

R. A. Pucel, "Design Considerations for Monolithic Microwave Circuits," IEEE Microwave Theory and Techniques, vol. MTT-29, No. 6, pp. 513-534, Jun. 1981.

L. Yuan, J. Paul, and P. Yen, "140 GHz Quasi-Optical Planar Mixers," Proceedings of IEEE MTT-S International Microwave Symposium, pp. 374-375, 1982.

I. C. Hunter and J. D. Rhodes, "Electrically Tunable Microwave Bandpass Filters," IEEE Microwave Theory and Techniques, vol. MTT-30, No. 9, pp. 1354-1360, Sep. 1982.

K. Chang and C. Sun, "Millimeter-Wave Power-Combining Techniques," IEEE Transactions on Microwave Theory and Techniques, vol. MTT-31, No. 2, pp. 91-107, Feb. 1983.

K. Chang et al., "V-Band Low-Noise Integrated Circuit Receiver," IEEE Transactions on Microwave Theory and Techniques, vol. MTT-31, pp. 146-154, Feb. 1983.

D. F. Williams and S. E. Schwarz, "Design and Performance of Coplanar Waveguide Bandpass Filters," IEEE Microwave Theory and Techniques, vol. MTT-31, No. 7, pp. 558-566, Jul. 1983.

H. J. Thomas et al., "Gunn Source Integrated with a Microstrip Patch," Microwave and RF, pp. 87-89, Feb. 1985.

M. Makimoto and M. Sagawa, "Varactor Tuned Bandpass Filters Using Microstrip-line Ring Resonators," IEEE MTT 14 S Digest, pp. 411-414, 1986.

D. F. Williams and S. E. Schwarz, "A Planar Subharmonically-Pumped 71 GHz Receiver with Integral Feed Antenna," International Journal of Infrared and Millimeter Waves, vol. 7, No. 2, pp. 183-195, 1986.

J. W. Mink, "Quasi-Optical Power Combining of solid-State Millimeter-Wave Sources," IEEE Transactions on Microwave Theory and Techniques, vol. MTT-34, pp. 273-279, Feb. 1986.

R. Janaswamy and D. H. Schaubert, "Characteristc Impedance of a Wide Slotline on Low-Permittivity Substrates," IEEE Transactions on Microwave Theory and Techniques, vol. MTT-34, pp. 900-902, Aug. 1986.

R. Janaswamy et al., "Analysis of the Transverse Electromagnetic Mode Linearly Tapered Slot Antenna," Radio Science, vol. 21, No. 5, pp. 797-804, Sep.-Oct., 1986.

S. Young and K. D. Stephan, "Stabilization and Power Combining of Planar Microwave Oscillators with an Open Resonator," IEEE MTT-S International Microwave Symposium Digest, pp. 185-188, 1987.

T. O. Perkins, "Active Microstrip Circular Patch Antenna," Microwave Journal, pp. 110-117, Mar. 1987.

K. Chang et al., "On the Study of Microstrip Ring and Varactor-Tuned Ring Circuits," IEEE Transactions on Microwave Theory and Techniques, vol. MTT-35, No. 12, pp. 1288-1295, Dec. 1987.

B. Schuppert, "Microstrip/slotlline Transitions-Modeling and Experimental Investigation," IEEE Microwave Theory and Techniques, vol. MTT-36, No. 8, pp. 1272-1282, Aug. 1988.

K. Chang et al., "Active Radiating Element Using FET Source Integrated with Microstrip Patch Antenna," IEE Electronic Letters, vol. 24, No. 21, pp. 1347-1348, 13th Oct. 1988.

T. S. Martin et al., "Theoretical and Experimental Investigation of Novel Varactor-Tuned Switchable Microstrip Ring Resonator Circuits," IEEE Microwave Theory and Techniques, vol. MTT-36, No. 12, pp. 1733-1740, Dec. 1988.

(List continued on next page.)

OTHER PUBLICATIONS

K. Chang et al., "Experiments on Injection Locking of Active Antenna Elements for Active Phased Arrays and Spatial Power Combiners," IEEE Transactions on Microwave Theory and Techniques, vol. MTT-37, No. 7, pp. 1078-1084, Jul. 1989.

H. Jingxi and F. Zhibo, "Analysis of Vivaldi Antennas," IEE 6th International Conference on Antennas and Propagation Part, 1, pp. 206-208, 1989.

K. S. Yngvesson et al., "The Tapered Slot Antenna-A New Integrated Element for Millimeter-Wave Applications," IEEE Transactions on Microwave Theory and Techniques, vol. MTT-27, No. 2, pp. 364-374, Feb. 1989.

J. Birkeland and T. Itoh, "Planar FET Oscillators Using Periodic Microstrip Patch Antennas," IEEE Transactions on Microwave Theory and Techniques, vol. MTT-37, No. 8, pp. 1232-1236, Aug. 1989.

U. Guttich, "Planar Integrated 20 GHz Receiver in Slotline and Coplanar Waveguide Technique," Microwave and Optical Technology Letters, vol. 2, No. 11, pp. 404-406, Nov. 1989.

A. Mortazawi and T. Itoh, "A Periodic Planar Gunn Diode Power Combiner Oscillator," IEEE Transactions on Microwave Theory and Techniques, vol. MTT-38, pp. 86-87, Jan. 1990.

Z. B. Popovic et al., "Bar-Grid Oscillators," IEEE Transactions on Microwave Theory and Techniques, vol. MTT-38, No. 3, pp. 225-230, Mar. 1990.

R. A. York and R. C. Compton, "A 4×4 Array Using Gunn Diodes," Submitted to IEEE AP-S International Symposium, Dallas, Texas, May 1990.

R. Alder, "A Study of Locking Phenomena in Oscillators," Proceedings IRE, vol. 34, pp. 351-357, Jun. 1946.

C. P. Wen, "Coplanar-Waveguide Directioinal Couplers," IEEE Microwave Theory and Techniques, vol. MTT-18, No. 6, pp. 318-332, Jun. 1970.

S. B. Cohn, "Slotline Field Components," IEEE Microwave Theory and Techniques, vol. MTT-20, pp. 172-174, 1972.

Y. Fujiki et al., "Higher-order Modes in Coplanar-type Transmission Lines," Electronics and Communications in Japan, 1975, vol. 58-B, pp. 74-80.

M. Houdart, "Coplanar Lines: Application to Broadhand Microwave Integrated Circuits," Proceedings of Sixth European Microwave Conference, 1976, pp. 49-53.

P. J. Gibson, "The Vivaldi Aerial," Proceedings of 9th European Microwave Conference, Brighton, UK, pp. 101-105, 1979.

E. Hammerstad and O. Jensen, "Accurate Models for Microstrip Computer-Aided Design," IEEE MTT—S Digest, 1980.

D. R. Chen and D. R. Decker, "MMIC's-The Next Generation of Microwave Components," Microwave Journal, pp. 67-69, May, 1980.

G. Ghinoe and C. Naldi, "Analytical Formulas for Coplanar Lines in Hybrid and Monolithic MICs," Electronics Letters, vol. 20, No. 4, pp. 179-187, FEb. 16 1984.

Y. C. Shin, L. Q. Bui, and T. Itoh, "Millimeter-Wave Diplexers with Printed Circuit Elements," IEEE Microwave Theory and Techniques, vol. MTT-33, No. 12, pp. 1465-1469, Dec., 1985.

U. Kotthaus and B. Vonwinkel, "Investigation of Planar Antennas for Sub-millimeter Receivers," IEEE Transactions on Microwave Theory and Techniques, vol. MTT-37, No. 2, pp. 364-374, Feb. 1989.

D

PLANAR ACTIVE ENDFIRE RADIATING ELEMENTS AND COPLANAR WAVEGUIDE FILTERS WITH WIDE ELECTRONIC TUNING BANDWIDTH

The United States government may have certain rights with respect to the invention pursuant to a funding arrangement with the Department of Defense.

BACKGROUND OF THE INVENTION

1. Field of the Invention

The present invention relates generally to microwave and millimeter-wave hybrid and monolithic integrated circuits, and more particularly to such circuits employing coplanar waveguide. Specifically, the present invention relates to circuits which combine coplanar waveguides and slotlines for constructing system components.

2. Description of the Related Art

There is an increasing demand for microwave and millimeter-wave hybrid and monolithic integrated circuits in many system applications. Due to their planar nature, these circuits offer cost, weight, reliability and reproducibility advantages when combined with photolithographic techniques. Microstrip has been the transmission line typically used in microwave circuit design partly because of the vast amount of design information available. Microstrip, however, has a number of disadvantages.

Although semiconductor devices can be readily integrated in series with the microstrip, shunt devices must be mounted by drilling through the substrate. Drilling adds cost and discontinuities which increase in the millimeter-wave region where tolerances become critical. Furthermore, the microstrip impedance and guided-wavelength characteristics are very sensitive to substrate thickness which further increases design problems at higher frequencies.

Coplanar waveguide (CPW) is an alternative transmission line that is truly planar and allows easy series and shunt device mounting CPW is not very sensitive to substrate thickness and allows a wide range of impedance values on relatively thick substrates. The radiation loss in the CPW odd mode is low for an open transmission line. These characteristics make CPW important for millimeter-wave circuits and has stirred considerable interest in microwave and millimeter-wave integrated circuit design.

Although the characteristics and relative advantages of CPW are known, only a limited number of CPW components are available for circuit design. These components include directional couplers, mixers, diplexers, and end-coupled resonant CPW filters.

SUMMARY OF THE INVENTION

Accordingly, the primary object of the present invention is to provide CPW circuit configurations that have general applicability to microwave and millimeter-wave hybrid and monolithic circuits.

Another object of the invention is to provide reproducible connections between CPW resonators, microstrips and slotlines.

A further object of the invention is to provide bias connections to active and passive devices for microwave and millimeter-wave power generation, tuning, mixing, frequency multiplication and switching.

A specific object of the invention is to provide an electronically tunable or switchable bandpass filter employing CPW resonators.

Another specific object of the invention is to provide an electronically-tuned active notch antenna and an electronically-tuned oscillator employing a CPW resonator.

Briefly, in accordance with a basic aspect of the present invention, microwave and millimeter-wave system components are fabricated by using slotlines extending from the periphery of CPW resonators. This technique permits the degree of electrical coupling between the CPW and the slotlines to be selected by dimensioning the width of the slotline. The CPW resonators and slotlines behave as if they were relatively independent circuit elements, permitting transmission line models to be useful design tools for predicting the behavior of the system components. The system components are fully planar and allow easy integration of active and passive semiconductor devices in series or in shunt with the CPW, and in shunt across the slotline. This technique also enables the conductive plane to be split for biasing semiconductor devices coupled to the CPW resonators for microwave and millimeter-wave power generation, tuning, frequency multiplication, mixing and switching. Power generation is provided, for example, by Gunn diodes or GaAs-FETs, electronic tuning is provided by varactor diodes, and switching is provided by PIN diodes.

In accordance with another aspect of the invention, a microstrip-to-slotline transition permits input and output coupling from the slotline to coaxial connectors. The microstrip-to-slotline transitions isolate DC biasing from coupling through the output coaxial connectors.

A bandpass filter incorporating the invention includes a plurality of CPW resonators interconnected by series slotline sections For a packaged filter, the microstrip-to-slotline transitions couple the filter inputs and output to coaxial connectors. These transitions permit DC biasing of varactor or PIN diodes shunting the CPW resonators for electronic tuning or switching.

An electronically-tuned active notch antenna includes a notch antenna interconnected to a CPW resonator via a slotline. The CPW resonator is shunted by an active device, or for independent electronic tuning, the slotline is shunted by a varactor, and one side of the CPW resonator is coupled to a slotline segment shunted by the active device.

BRIEF DESCRIPTION OF THE DRAWINGS

Other objects and advantages of the invention will become apparent upon reading the following detailed description and upon reference to the drawings in which.

Figure 1:
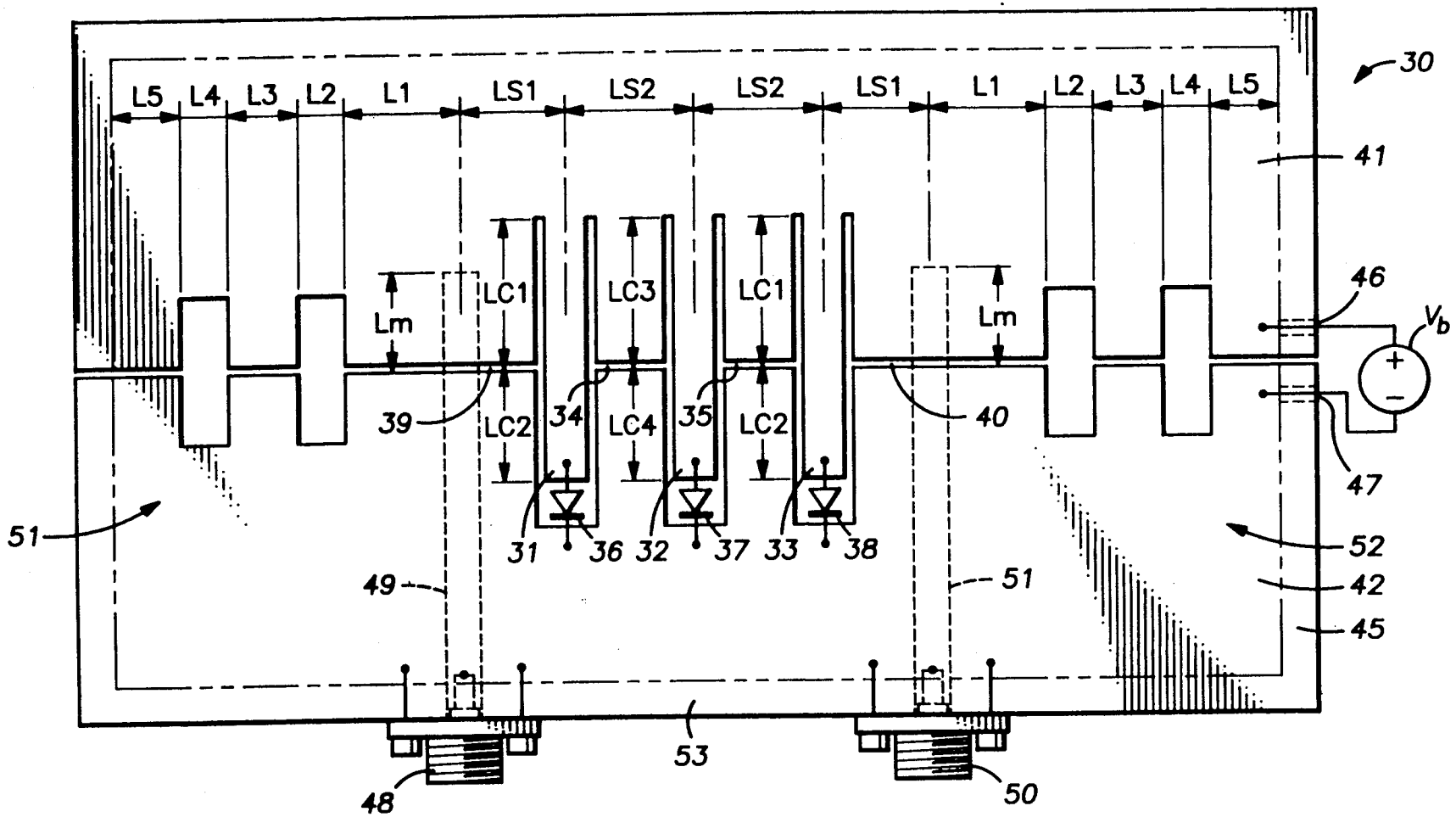
FIG. 1 is a plan view of a bandpass filter incorporating CPW resonators interconnected by slotlines and microstrip-to-slotline transitions in accordance with the present invention.

While the invention is susceptible to various modifications and alternative forms, specific embodiments thereof have been shown by way of example in the drawings and will herein be described in detail. It should be understood, however, that it is not intended to limit the invention to the particular form disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to FIG. 1, there is shown a plan view of a bandpass filter generally designated 30. In accordance with a basic aspect of the present invention, the filter 30 has its frequency response defined by a series of CPW resonators 31, 32, 33 which are interconnected by slotlines 34 and 35. The configuration permits the degree of coupling between the CPW resonators to be precisely controlled during the planar fabrication process. In addition, the configuration permits series and shunt connections to be made to the resonators. Each resonator, for example, is shunted by a respective semiconductor diode 36, 37, 38 to provide control of the frequency response of the filter. The diodes, for example, are varactor diodes to permit electronic tuning of the frequency response, or PIN diodes to permit switching of the pass-band of the filter between an open and a closed state.

Series input and output connections are also made to the resonators by respective slotlines 39 and 40. To permit the application of a control voltage to the diodes 36, 37, 38 the slotlines 39 and 40 extend outward to the periphery of the filter 30 so as to subdivide the filter into a first conductive plane 41 and a second conductive plane 42. The conductive planes 41 and 42, for example, are formed on a substrate by photolithographic etching of a metal film layer deposited on an insulating substrate. The substrate, for example, is a 50 mil thick sheet of polytetrafluroethylene reinforced with micro-glass fibers, which is sold under the trademark RT-Duroid 6010.5

To permit a relatively high degree of isolation between the inputs and outputs of the bandpass filter 30 when the filter is inserted in a system, the filter 30 is encased in a metal box or otherwise circumscribed by metal shielding. The conductive planes 41 and 42 and the substrate upon which they rest are supported in the shields in such a way that the outer periphery of the conductive planes is held at RF ground potential. For the filter 30 shown in FIG. 1, this can be done by peripheral shielding 45 which is delimited by phantom lines. The shielding, for example, is in the form of top and bottom portions of a rectangular metal box which is not otherwise shown in detail. The conductive metal planes 41 and 42 and the substrate upon which they rest, for example, are sandwiched between upper and lower parts of this metal box (not shown). The metal box itself is conventional, but when used in connection with the filter 30, additional means provide DC insulation between the metal box and at least one of the conductive metal planes 41 and 42. For the filter 30 shown in FIG. 1, the metal plane 42 is selected as the ground plane and it is in direct connection with the shield 45. The outer periphery of the metal plane 41, however, is insulated from the metal shield 45, for example, by thin strips of plastic tape inserted between the shield 45 and the metal conductor plane 41.

To apply a bias potential between the conductive plane 41 and the conductive plane 42, a wire 46 is soldered to the plane 41 and a wire 47 is soldered to the plane 42. The wires 46, 47 extend through holes in the shield 46 to an external source $V_b$ of bias potential.

To provide input and output connections to the bandpass filter 30, an SMA connector 48 is connected via a microstrip 49 to the slotline 39, and an SMA connector 50 is connected via a microstrip 51 to the slotline 40. The microstrips 49 and 51 are formed on a bottom conductive layer on an opposite side from the substrate as the conductive layers 41 and 42. Therefore, the microstrips 49 and 51 are shown in dashed representation. In addition, the peripheral ends of the slotlines 39 and 40 are terminated by slotline low-pass filters generally designated 52 and 53, respectively.

A rather critical parameter affecting the coupling between the microstrips 49, 51 and the slotlines 39, 40 is the overlap Lm. In general, this overlap should be about a quarter of a wavelength, taking into account end effects.

Figure 2:
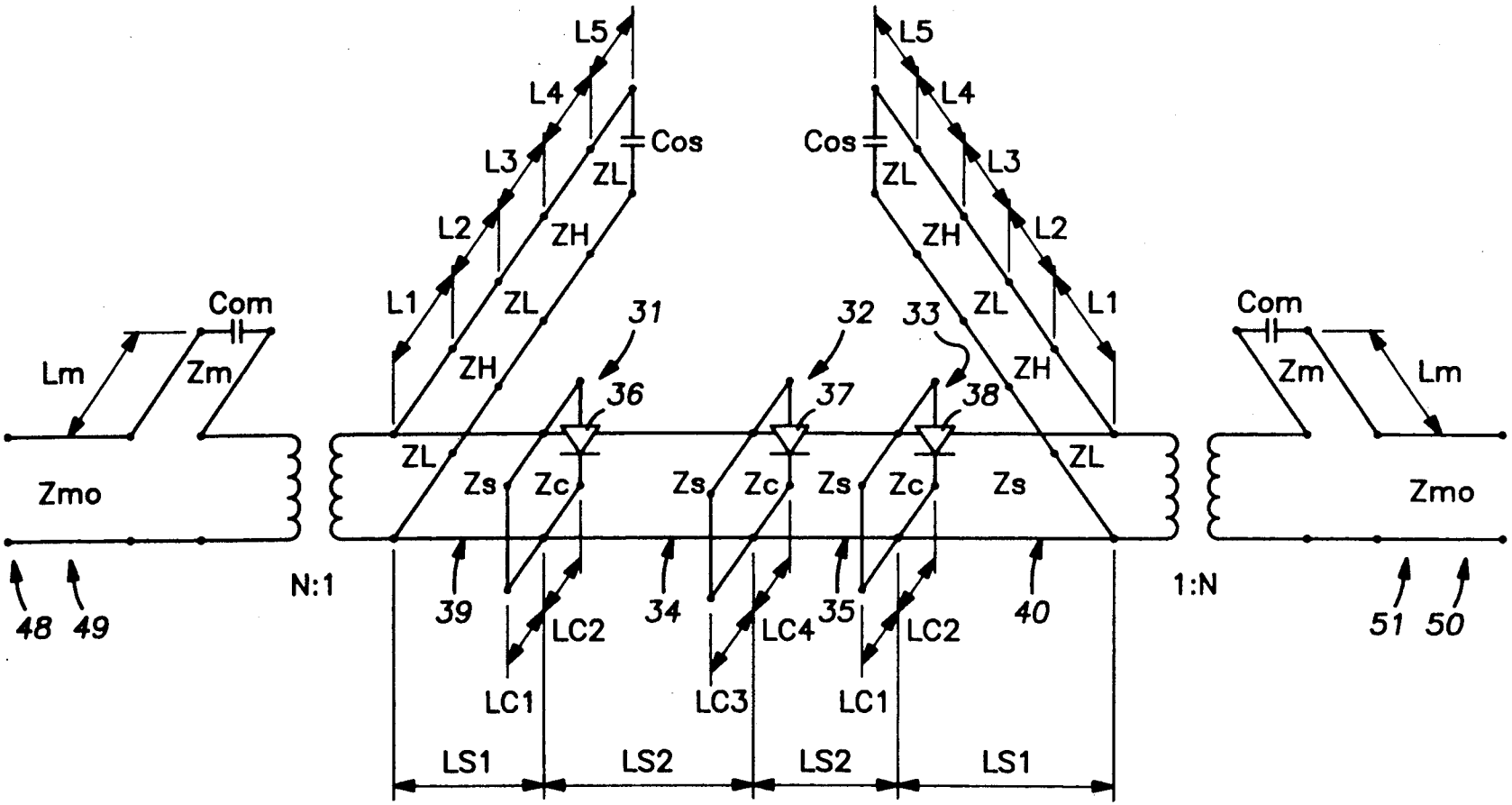
FIG. 2 is a schematic diagram of a transmission line model for the bandpass filter of FIG. 1.

The design of the bandpass filter 30 for a desired frequency response is most easily performed by reference to a transmission line model such as the model shown in FIG. 2. In fact, one of the advantages of the present invention is that the transmission line model provides a fairly accurate prediction of performance for the slotline-to-CPW resonator and microstrip-to-slotline connections of the present invention. This is a consequence of the fact that the CPW resonators and the slotline segments are fairly independent circuit elements, except at their interconnecting regions.

The equivalent circuit of FIG. 2 was used to generate a computer model of the cascaded transmission lines. The model accounts for all open and short termination effects. To obtain the parameters in the equivalent circuit of FIG. 2, closed form equations were solved as described in G. Ghinoe and C. Naldi, "Analytical Formulas for Coplanar Lines in Hybrid and Monolithic MICs," *Electronic Letters*, Vol. 20, No. 4, pp. 179–187, Feb. 16, 1984. The characteristic impedance of the CPW resonators 31, 32, 33 is 50 ohms, and the characteristic impedance of the interconnecting slotlines 34, 35, 39 and 40 is 60 ohms.

To minimize optimization variables, the lengths of the first and third resonators 31, 38 were set equal to each other. The optimization criteria were to provide coupling through the microstrip to slotline transitions throughout the 2.0–4.0 GHz range, and to achieve at least 30 dB insertion loss in the stop-bands from 2.0 to 2.5 and 3.3 to 4.0 GHz, and less than 0.2 dB insertion loss in the passband of 2.75 to 3.05 GHz. The resulting optimized values for the bandpass filter when the diodes 36, 37, and 38 were omitted, were $L_{c1}=18.70$ mm, $Lc_2=16.23$ mm, $L_{c3}=18.26$ mm, $L_{c4}=17.00$ mm, $L_{s1}=3.00$ mm, $L_{s2}=10.35$ mm, $L_1=4.90$ mm, $L_2=0.90$ mm, $L_3=0.76$ mm, $L_4=2.53$ mm, $L_5=15.90$ mm, and $L_m=9.70$ mm.

Figure 3:
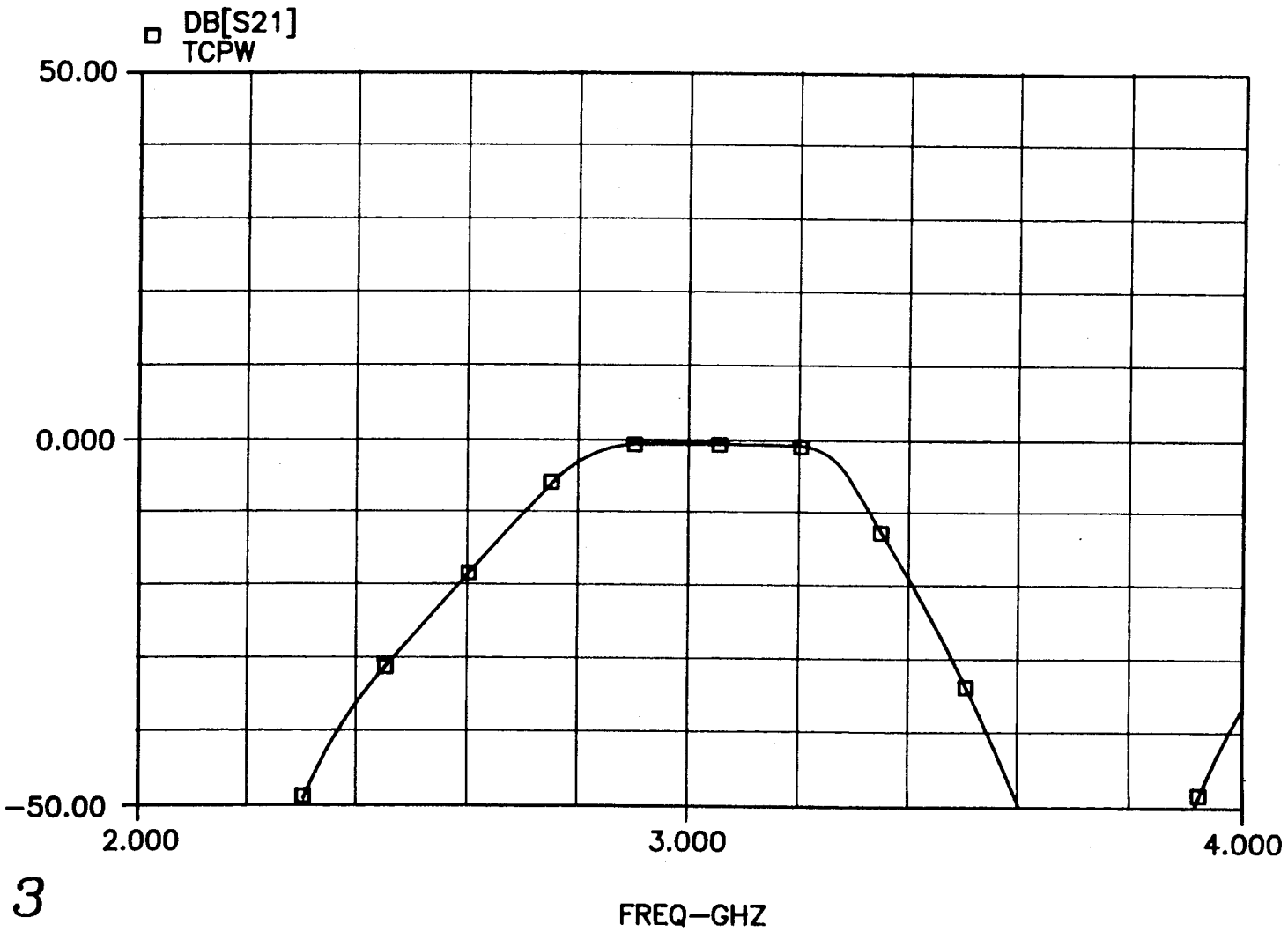
FIG. 3 is a graph of insertion loss versus frequency for the transmission line model of FIG. 2, with diodes in the model removed.
Figure 4:
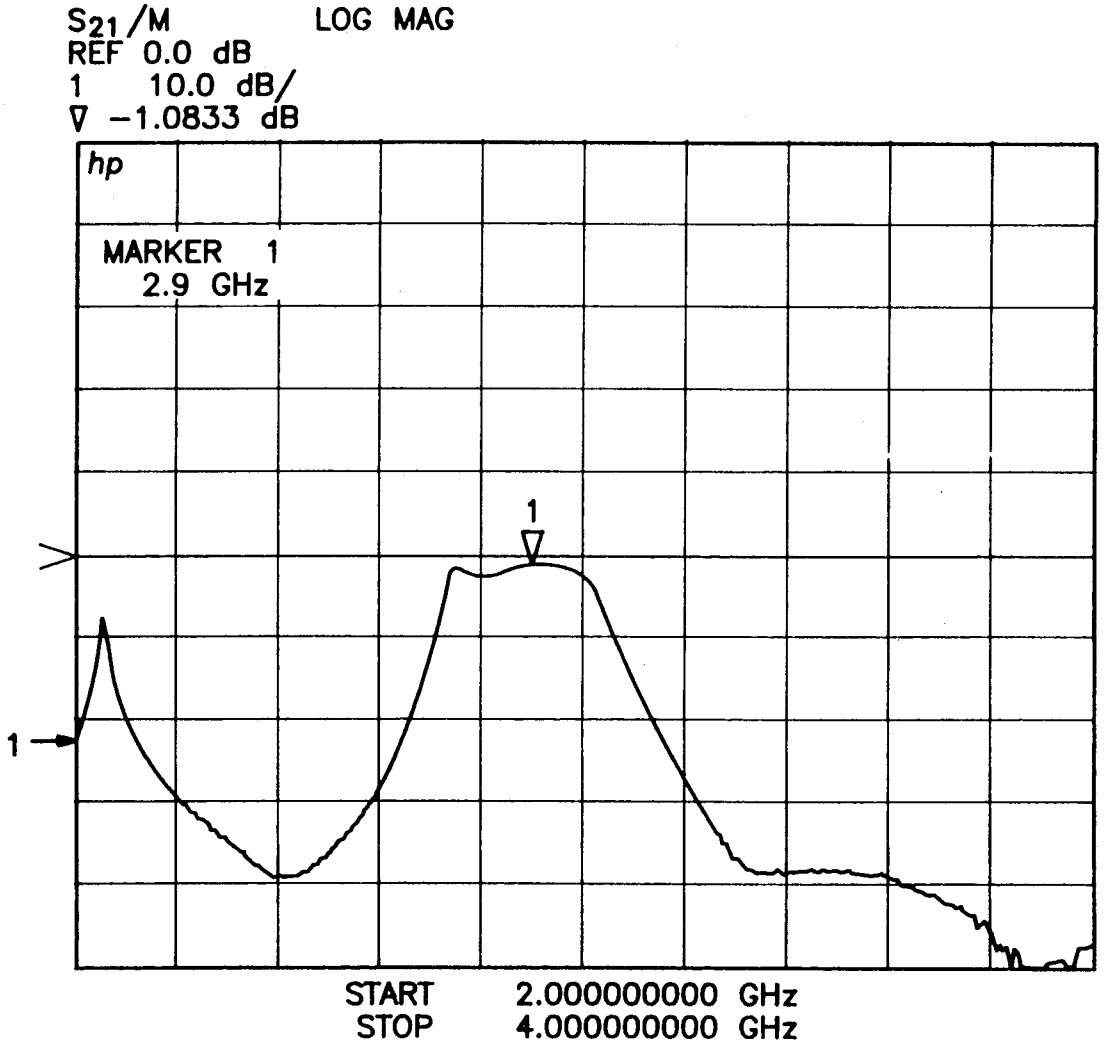
FIG. 4 is a graph of insertion loss as a function of frequency for the bandpass filter of FIG. 1 with the diodes removed.

The filter of FIG. 1 was fabricated and tested by interconnecting the circuit 30 to the SMA connectors 48 and 50 mounted on only the front portion 53 of the shield 45. The S-parameters were tested using a HP-8510 Network Analyzer. The theoretical insertion loss computed from the equivalent circuit of FIG. 2 is shown in FIG. 3. In contrast, the measured insertion loss is plotted in FIG. 4. In the 400 MHz pass-band, the theoretical insertion loss is about 0.7 dB at a center frequency of 2.9 GHz. The experimental results of the filter 30 show a center frequency of 2.9 GHz with a 300 MHz pass-band and insertion loss of less than 1.2 dB. The stop-band isolation is greater than 20.0 dB except for a feedline resonance at 2.1 GHz. The theoretical model and the experimental results show good agreement and are easily modified for different frequencies and pass-band characteristics.

Figure 5:
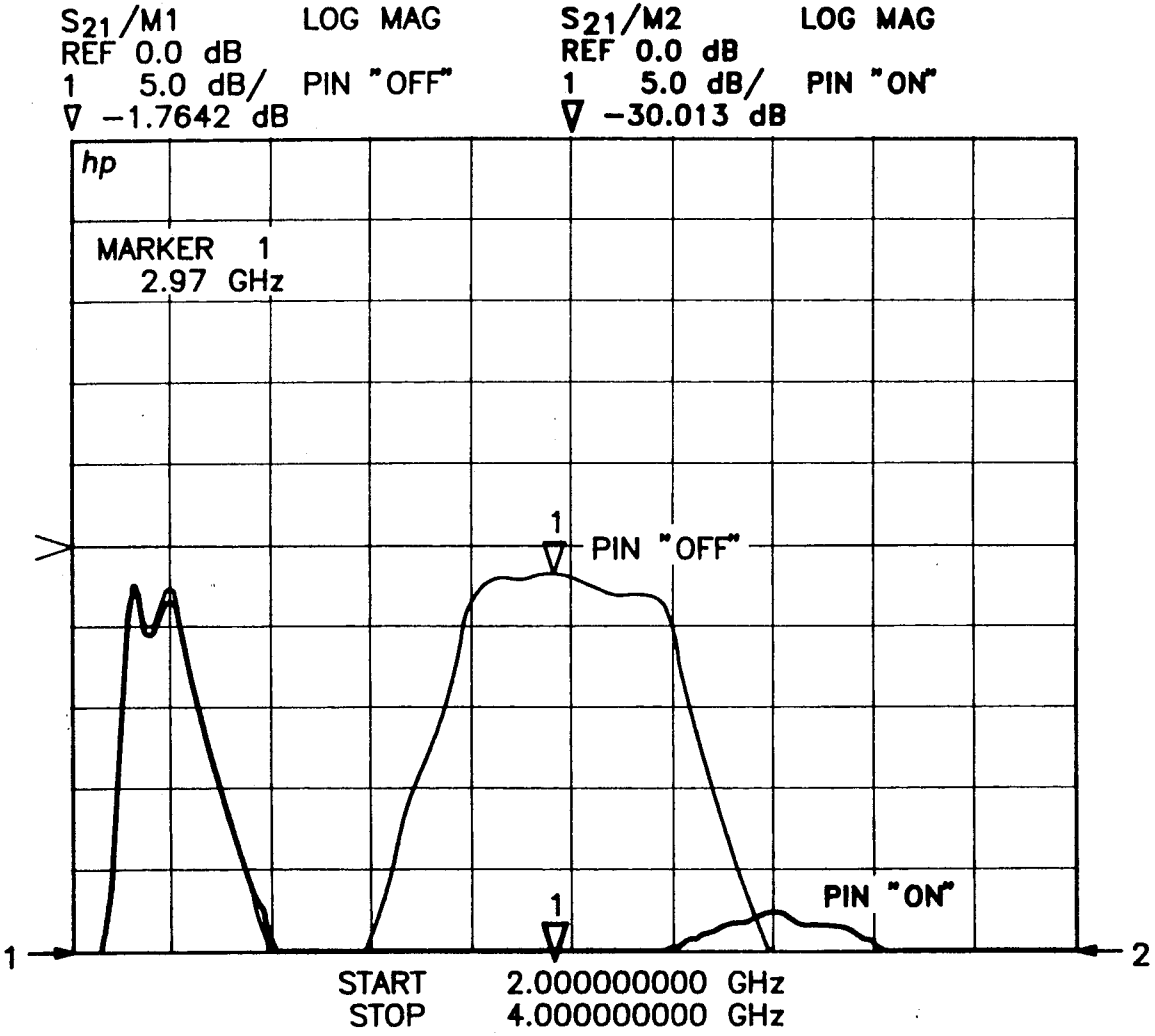
FIG. 5 is a graph of insertion loss as a function of frequency for the bandpass filter of FIG. 1 using PIN diodes and showing the response obtained when the diodes are biased "on" and biased "off"

To permit the band-pass filter 30 to be switched on and off, the open ends of the CPW resonators are shunted by PIN diodes 36, 37 and 38. The PIN diodes, for example, are M/ACOM Part No. 47049. When PIN diodes are used, the optimum dimensions for the filter compensated for PIN diode package parasitics are $L_{c1}=19.99$ mm, $L_{c2}=15.45$ mm, $L_{c3}=19.93$ mm, $L_{c4}=12.19$ mm, $L_{s1}=3.18$ mm, and $L_{s2}=9.23$ mm. The measured frequency response of the switchable filter is shown in FIG. 5. When the PIN diodes are "off" or reverse biased, the center frequency is 3.0 GHz with a 3.0 dB bandwidth of 400 MHz and insertion loss of 1.0 dB excluding the two transition losses of 1 dB. When the PIN diodes are "on", the isolation is at least 30.0 dB across the 2.0–4.0 GHz range.

To electronically tune the filter 30, the diodes 36, 37 and 38 are varactor diodes. The varactor diodes, for example, are M/ACOM Part No. 46600, which have a junction capacitance that varies from 0.5 to 2.5 pF as the bias voltage $V_b$ is varied from zero to 30 volts. For design and optimization purposes, the junction capacitance was assumed to be 1.0 pF and the filter was optimized for a center frequency of 3.0 GHz and a plus and minus 200 MHz bandwidth, less than 1.5 dB insertion loss, and over 30.0 dB isolation in the stop bands. The optimized parameters for the varactor-tuned bandpass filter were $L_{c1}=19.57$ mm, $L_{c2}=8.84$ mm, $L_{c3}=19.99$ mm, $L_{c4}=8.59$ mm, $L_{s1}=3.20$ mm, and $L_{s2}=9.03$ mm.

Figure 6:
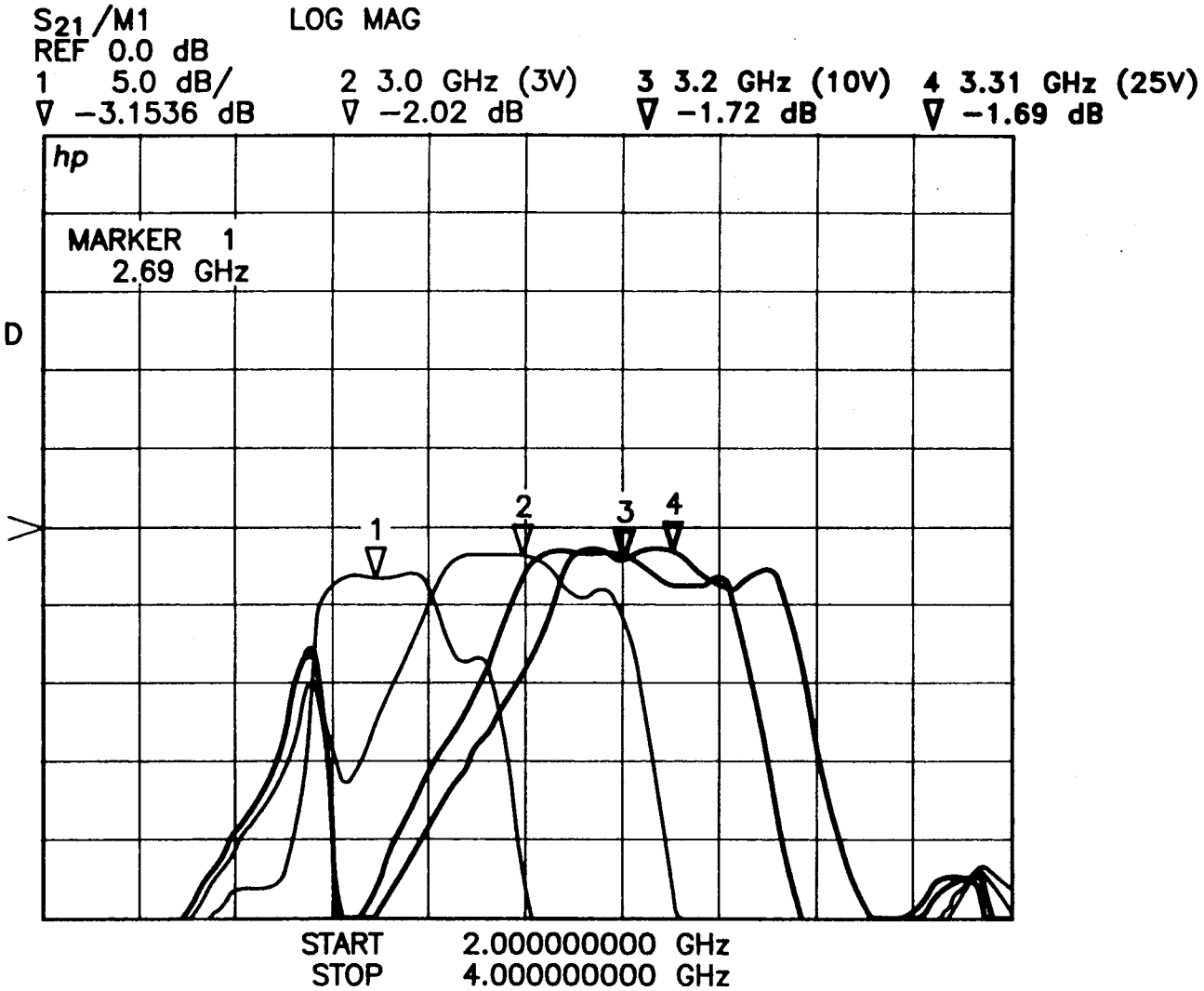
FIG. 6 is a graph of insertion loss as a function of frequency for the bandpass filter of FIG. 1 using varactor diodes and showing the response for four different levels of bias voltage upon the varactor diodes.

Shown in FIG. 6 is the frequency response of the varactor-tuned bandpass filter for reverse bias voltages of zero volts, 3 volts, 10 volts, and 25 volts. The varactor-tuned filter achieved a tuning bandwidth of 600 MHz for varactor bias voltages of zero to 25 volts. The results in FIG. 6 include the losses due to two transitions. Excluding these losses, a maximum insertion loss of 2.15 dB occurred at the low-end frequency of 2.7 GHz and the insertion loss decreased to 0.7 dB at the high-end frequency of 3.3 GHz. The 3.0 dB pass-band varied from 250 MHz in the low-end to 450 MHz in the high-end.

From the experimental results, it should be apparent that bandpass filters incorporating the CPW resonator, slotline and microstrip transitions of the present invention are readily designed for selected frequencies and frequency response characteristics. Although the circuit 30 shown in FIG. 1 uses three resonator sections, additional resonator sections can be used to provide additional selectivity. The invention offers low-cost, low-loss, high-isolation and ease of series and shunt device integration to a truly planar circuit. Moreover, the switchable and tunable bandpass circuits are applicable to many microwave system tasks requiring high switching and tuning speeds.

Another application of the present invention is active planar antennas. Due to the power limitations of active solid-state radiating elements, there is much interest in using spatial power combining techniques to create a coherent and higher-power signal from many low-power radiating sources. In addition, spatial or quasi-optical power combining is not limited by size or modding problems and allows the combination of a great number of active radiating elements.

A known kind of planar antenna is the notch antenna. The notch antenna has many desirable characteristics which include broad impedance matching bandwidth and planar nature, as well as good reproducibility, and ease of integration to passive and active devices. In particular, the notch antenna has been used in a receiver front-end. The present invention, however, provides a mechanism for easily integrating active solid-state radiating elements to the notch antenna to provide active notch antennas that are readily injection-locked or power combined to form large arrays of radiating elements.

Figure 7:
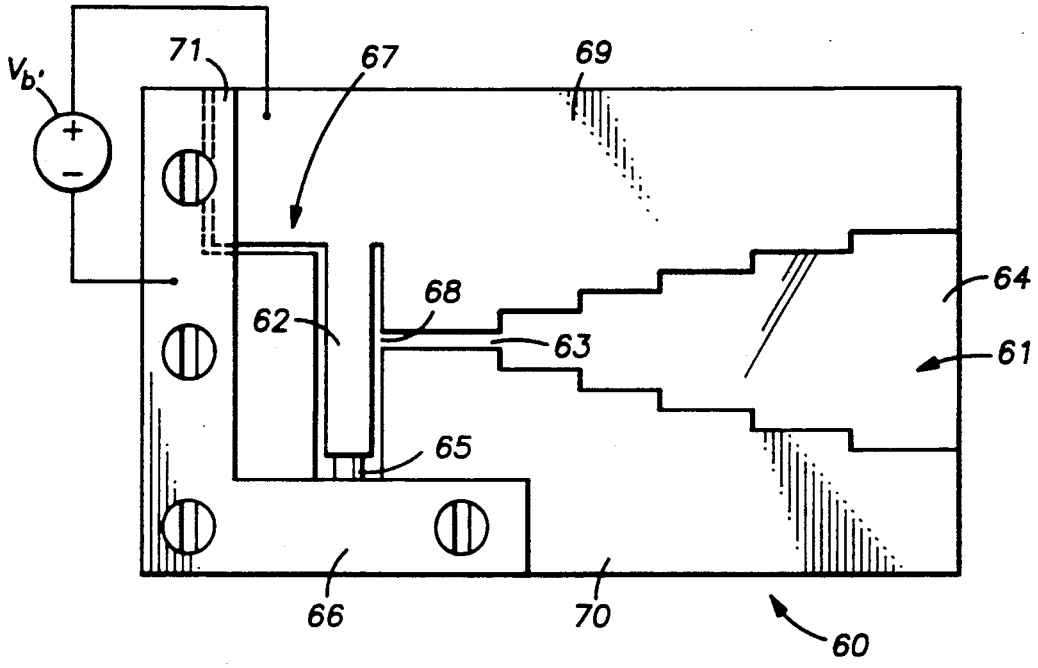
FIG. 7 is a plan view of an active stepped-notch antenna incorporating a CPW resonator coupled to the notch via a slotline in accordance with the invention.

Turning now to FIG. 7, there is shown an active CPW stepped-notch antenna circuit 60 incorporating the present invention. The circuit includes a stepped-notch antenna 61 coupled to a CPW resonator 62 via slotline 63. The stepnotch antenna 61 is formed, in effect, by many step transformers which match the slotline impedance to free space. The antenna and resonator are fabricated on a 60 mil thick substrate 64 of microfiber reinforced polytetrafluroethylene, sold under the trademark RT-Duroid 5870. This substrate material has a low relative dielectric constant of about 2.3, which promotes matching of the notch antenna 61 to free space. A Gunn diode 65 is mounted in a heat-sink 66 at the open end of the resonator 62. The Gunn diode, from M/ACOM, is rated at 72 mW.

The resonator 62 is important for improved oscillations and stability. CPW is used for the resonator to maintain a planar configuration and to provide ease of integration with active devices. In the stepped-notch antenna configuration of FIG. 7, the CPW slots were 0.3 mm with a 3.5 mm separation. This arrangement provides a 50 ohm characteristic impedance and mates well with the 3.5 mm cap of the Gunn diode. The length of the resonator 62 was approximately 0.5 wavelengths, taking into account some extra length on the shorted end. A DC block 67 was incorporated at the shorted end to permit biasing of the Gunn diode by an external voltage source $V_b'$. The DC block subdivides the conductive metal patterns on the substrate 64 into a first pattern 69 and a second pattern 70. The first pattern 69 is insulated from the heat sink 66, for example, by thin plastic tape sandwiched between the first pattern 69 and the heat sink 66 at the region of overlap 71.

Figure 8:
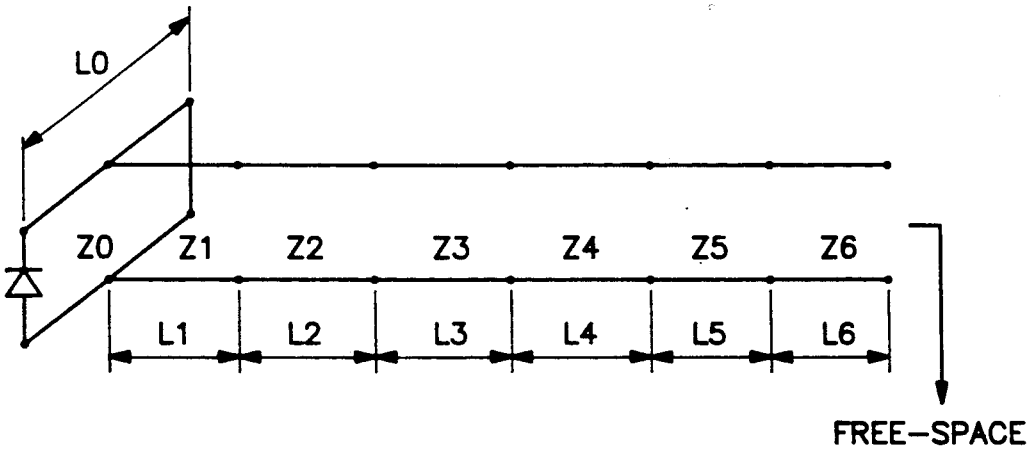
FIG. 8 is a schematic diagram of a transmission line model for the active stepped-notch antenna of FIG. 7.

Matching from free space to the resonator 62 was optimized using a transmission line model shown in FIG. 8. The input impedance of the slot-line 63 was matched to the resonator at the coupling point 68, and the lengths of the transformer sections were optimized for minimum return-loss throughout X-band.

Figure 9:
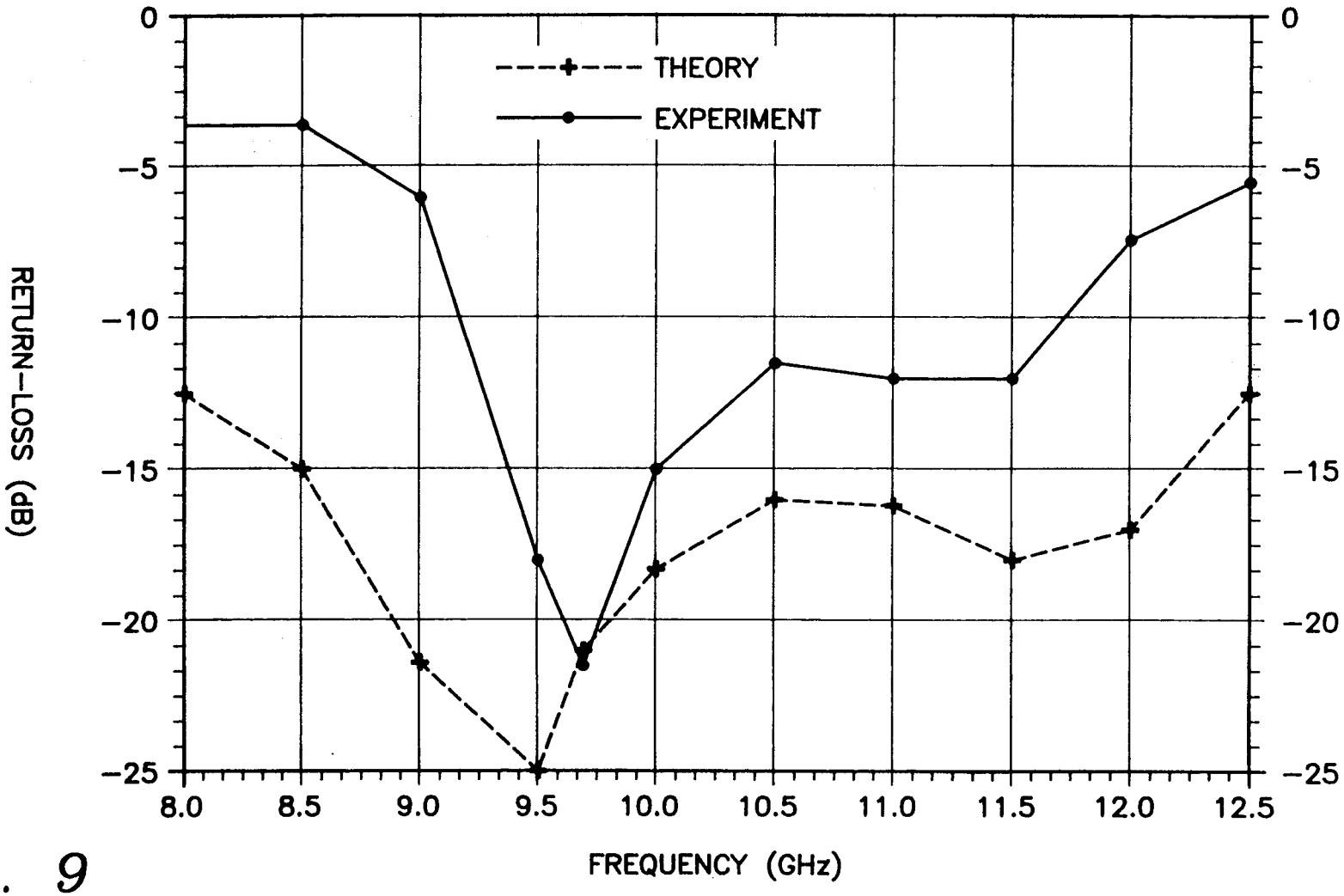
FIG. 9 is a graph of return-loss as a function of frequency including theoretical results computed from the transmission line model of FIG. 8 and experimental results measured from the active stepped-notch antenna of FIG. 7.

To test the passive circuit, an SMA connector (not shown) was soldered onto the open end of the CPW resonator, and measurements were performed on an HP-8510 Network Analyzer The theoretical and measured return-loss ($S_{11}$) agree fairly well as shown in FIG. 9. The stepped-notch antenna gain was measured at 9.3 and 9.6 GHz and found to be 7.1 and 7.7 dBi, respectively. These gains were used to calculate the active notch antenna power output with a modified form of the Friis Transmission Equation:

$$P_t = P_r\left(\frac{4\pi R}{\lambda}\right)^2\left(\frac{1}{G_{ot}G_{or}}\right) \quad (1)$$

where:

$p_r$=Power received.

$p_t$=Power transmitted from the active notch antenna.

$\lambda$=Wavelength of operation.

R=Range length.

$G_{ot}$=Gain of the transmit antenna.

$G_{or}$=Gain of the receive antenna.

Figure 10:
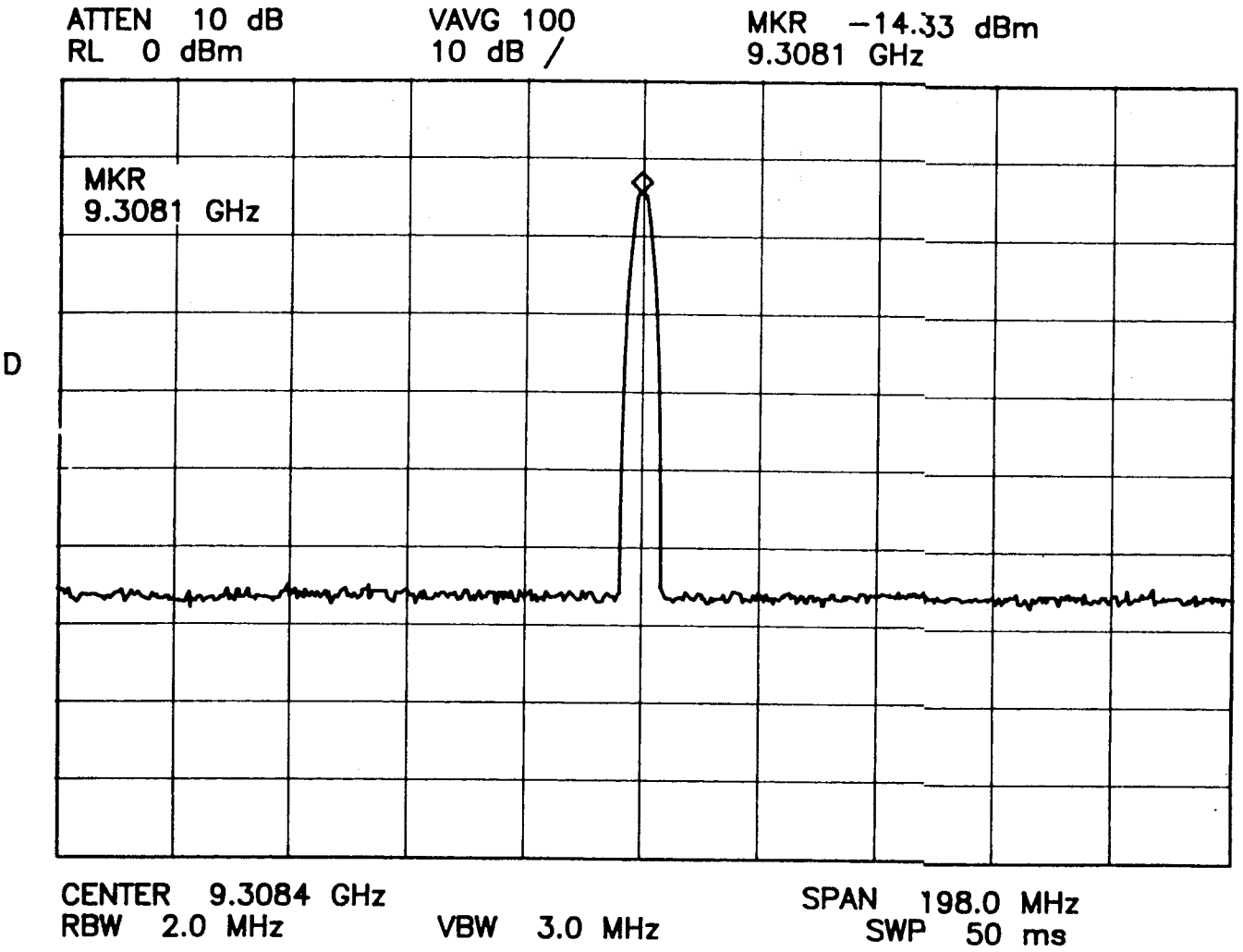
FIG. 10 is a graph of the received signal spectrum from the active stepped-notch antenna of FIG. 7.
Figure 11:
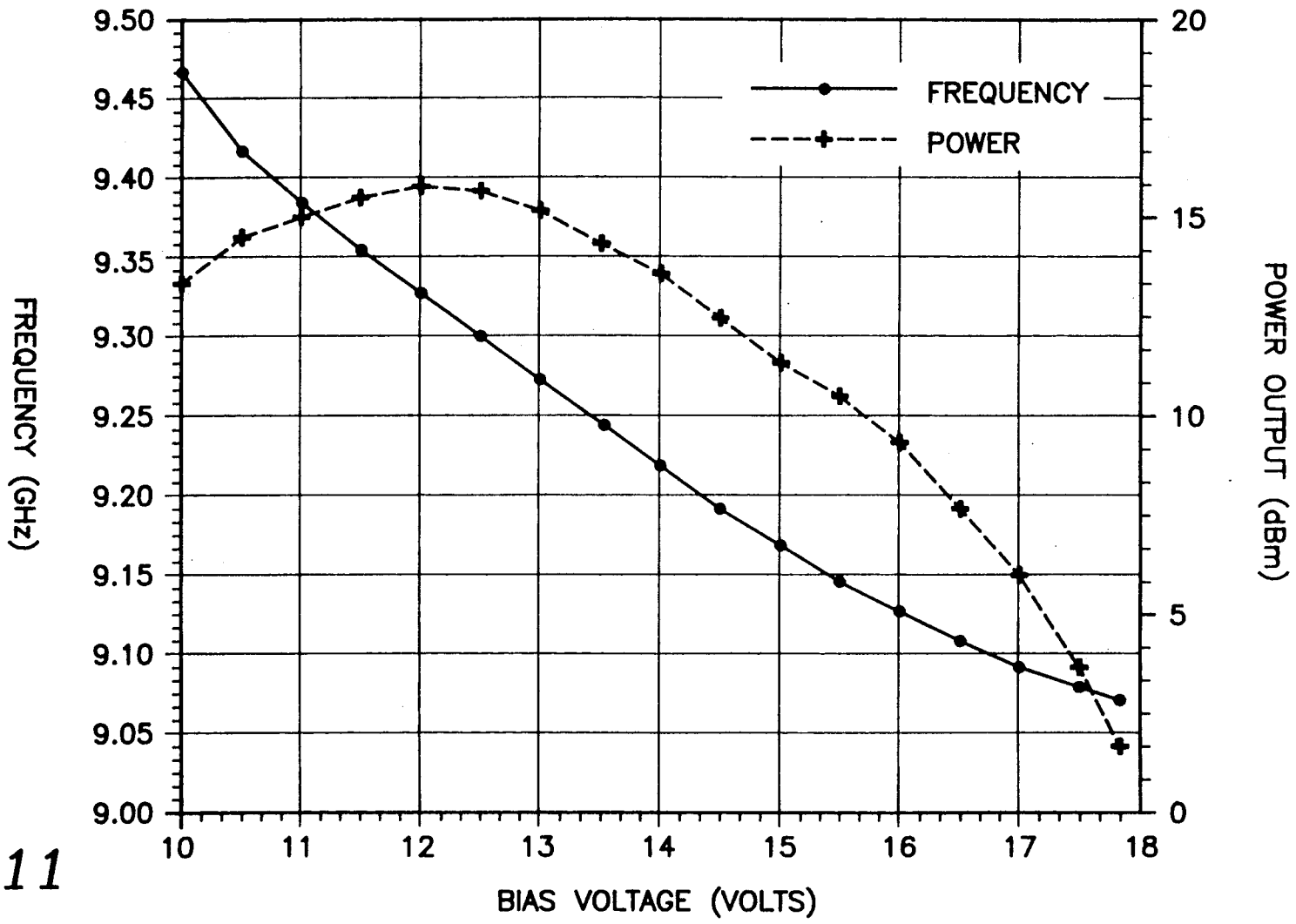
FIG. 11 is a graph of the frequency and power output versus bias voltage for the active stepped-notch antenna of FIG. 7.

FIG. 10 shows the spectrum of the active stepped-notch antenna 60 measured at a microwave receiver (not shown) spaced from the antenna. The bias voltage vs. frequency and power output is shown in FIG. 11. The 3 dB bias-tuning bandwidth was 275 MHz centered at 9.33 GHz with a maximum power output of 37.5 mW at 9.328 GHz. The power output and bias tuning bandwidth, however, are dependent upon the precise position of the Gunn diode. A change in Gunn diode position, for example, was found to increase the maximum output power to 62 mW at 9.426 GHz, but with a decrease in bias-tuning bandwidth to 117 MHz occurring at 9.445 GHz.

Figure 12:
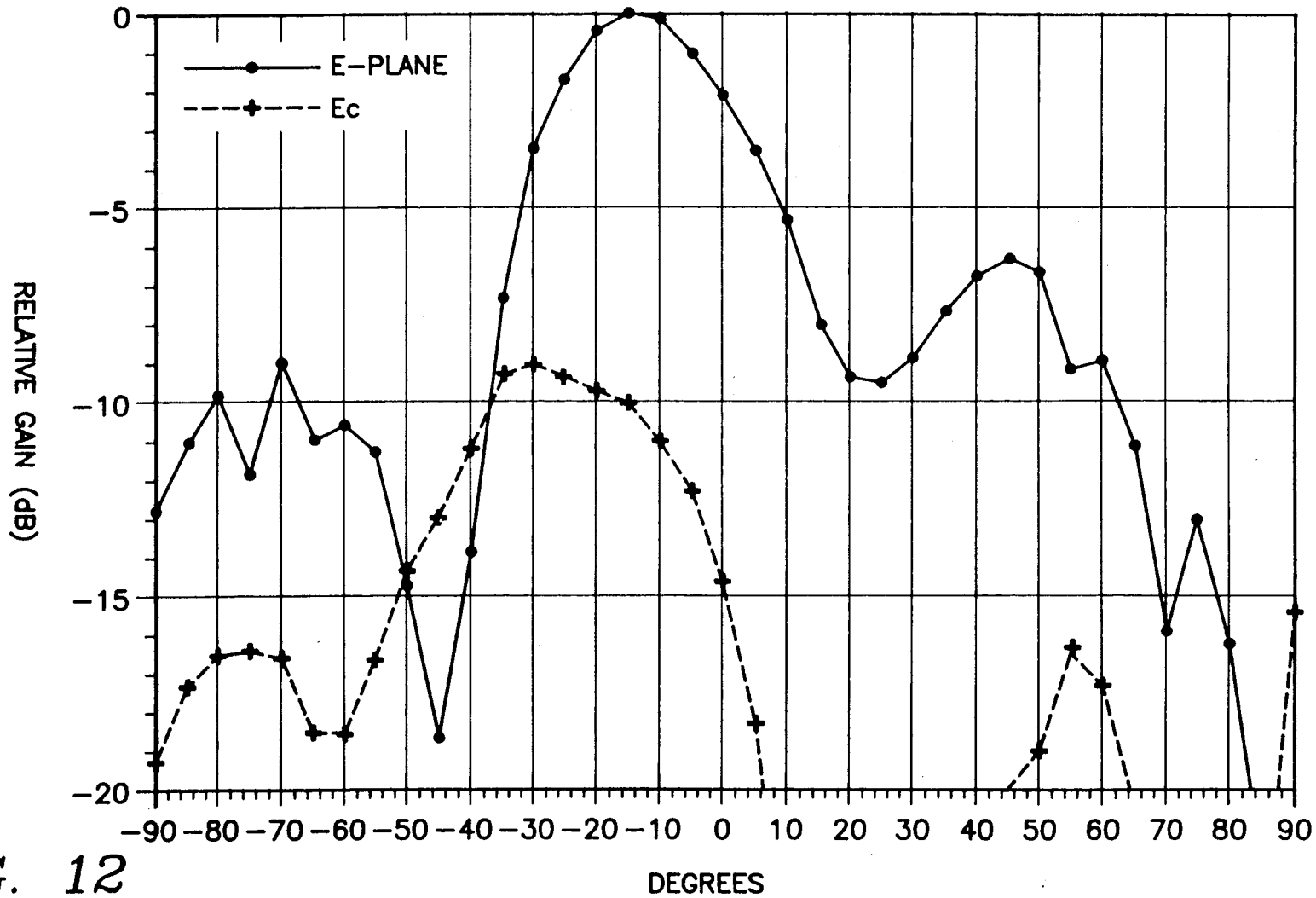
FIG. 12 is a graph of E-plane and E-field cross-polarization patterns for the active stepped-notch antenna of FIG. 7.
Figure 13:
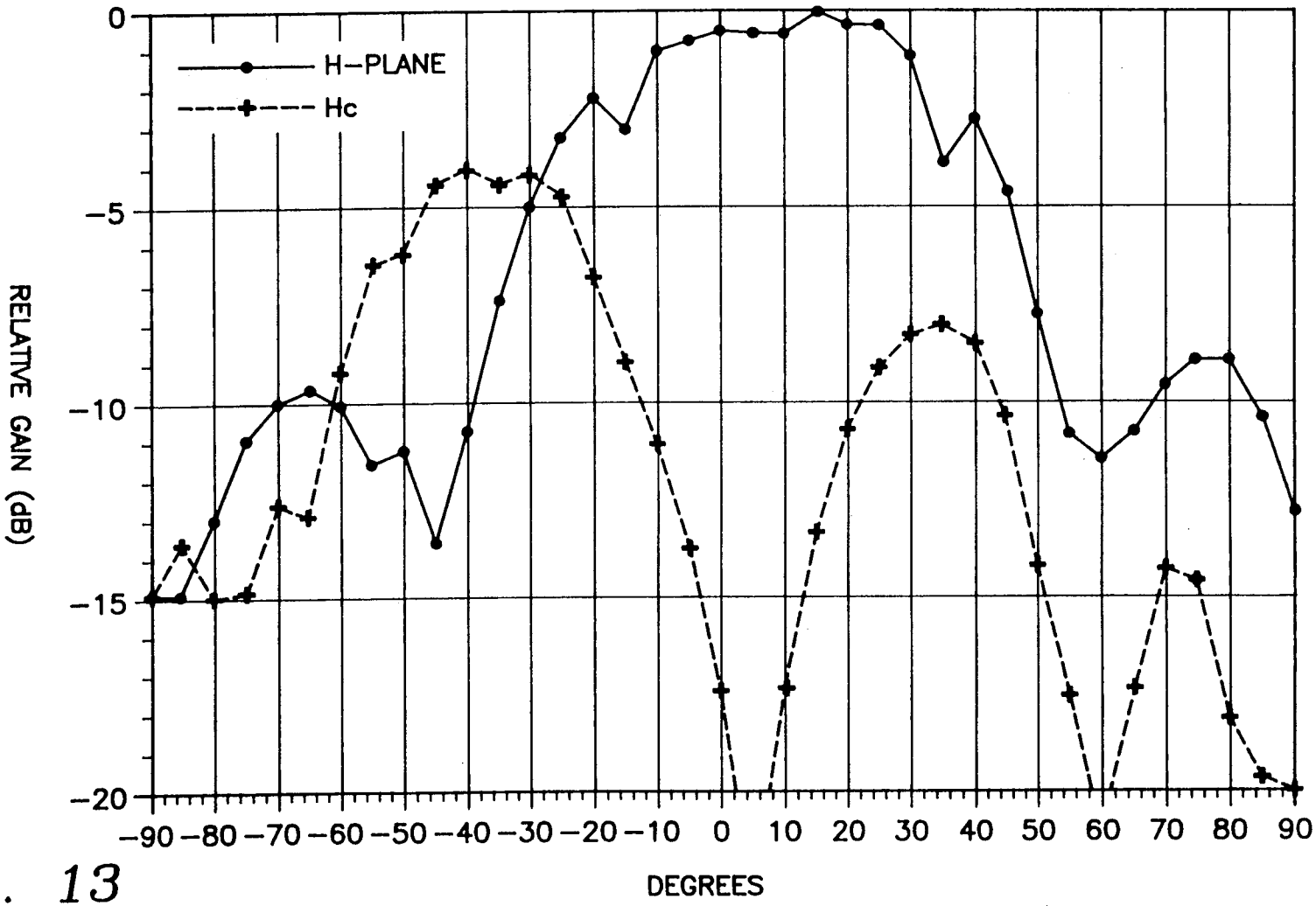
FIG. 13 is a graph of H-plane and H-field cross-polarization patterns for the active stepped-notch antenna of FIG. 7.

The E and H-field patterns of the active stepped-notch antenna as well as the cross-polarization level measurements are shown in FIGS. 12 and 13, respectively. The heat sink introduces some asymmetry in the E-plane pattern and the high level of cross-polarization can be attributed to the orientation of the CPW resonator.

The active CPW stepped-notch antenna of FIG. 7 was somewhat limited in two respects. First, the bias tuning created a large deviation in output power due to the inherent Gunn diode impedance characteristics. Second, the cross-polarization at some angles was high due to the orientation of the CPW resonator and the low dielectric constant of the substrate which allows efficient radiation.

These limitations can be overcome by incorporating a varactor and modifying the orientation of the CPW resonator in the active antenna to increase the tuning bandwidth, maintain a fairly constant output power level, and reduce the cross-polarization level while maintaining the same spectral quality of the signal.

Figure 14:
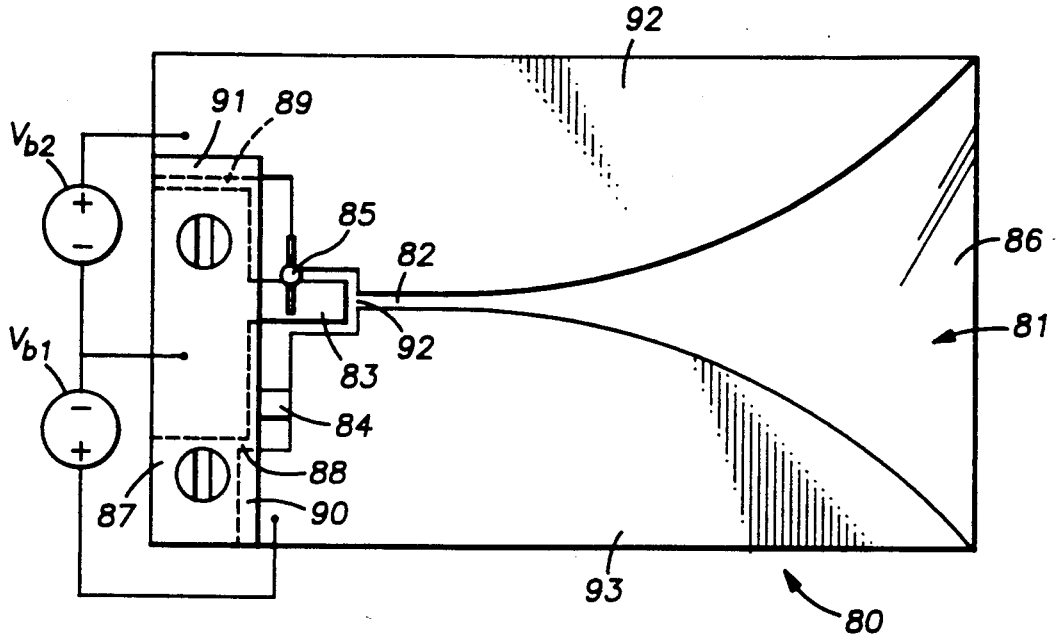
FIG. 14 is a plan view of a varactor-tuned active notch antenna.
Figure 15:
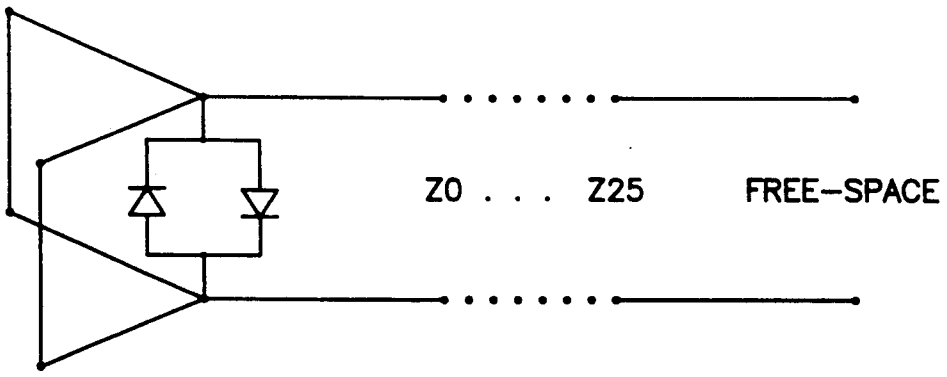
FIG. 15 is a schematic diagram of a transmission line model for the varactor-tuned active notch antenna of FIG. 14.

FIG. 14 shows such a varactor-tuned active notch antenna configuration 80. Its equivalent circuit is shown in FIG. 15. The antenna configuration 80 includes a notch antenna 81 coupled by a slotline 82 to a varactor-tuned CPW resonator 83. A Gunn 84 diode and a varactor diode 85 are placed at adjacent sides of the CPW resonator 83. The Gunn diode 84 (rated at 80 mW) and the varactor diode 85 (rated at 1.6 pf at 0 volts) were obtained from M/ACOM. The antenna configuration 80 was etched on a 60 mil thick RT-Duroid 5870 substrate 86. The overall dimensions of the substrate were 1×2 inches. A metal heat sink 87 for the Gunn diode 84 was fastened to the substrate.

The primary difference between the circuit of FIG. 7 and the circuit of FIG. 14 is in the Gunn diode placement. In the FIG. 7 circuit, the Gunn diode 65 is placed at the open end of the CPW resonator 62 to feed the resonator symmetrically In the circuit of FIG. 14, the Gunn diode 84 feeds one side of the CPW resonator 83, and the varactor 85 is mounted on the other side of the CPW resonator.

In FIG. 14, the CPW resonator 83 provides ease of multiple device integration and DC blocks 88, 89 for separate biasing. The overlap regions 89, 90 between the metal heat sink 87 and the conductive metal patterns 92, 93 have insulating plastic tape sandwiched between the metal heat sink and the conductive metal patterns 92, 93 to maintain the DC blocks 88, 89 and permit independent biasing of the Gunn diode 84 and the varactor diode 85 by external voltage sources $V_{b1}$, $V_{b2}$.

The length of the CPW resonator 83 was chosen to be approximately 0.5 wavelengths while taking into account the package effects of the diodes 84, 85. The input impedance of the notch antenna 81 was matched at the coupling point 92 with the resonator 83. The notch antenna 81 was tapered instead of stepped for improved wide bandwidth performance.

Figure 16:
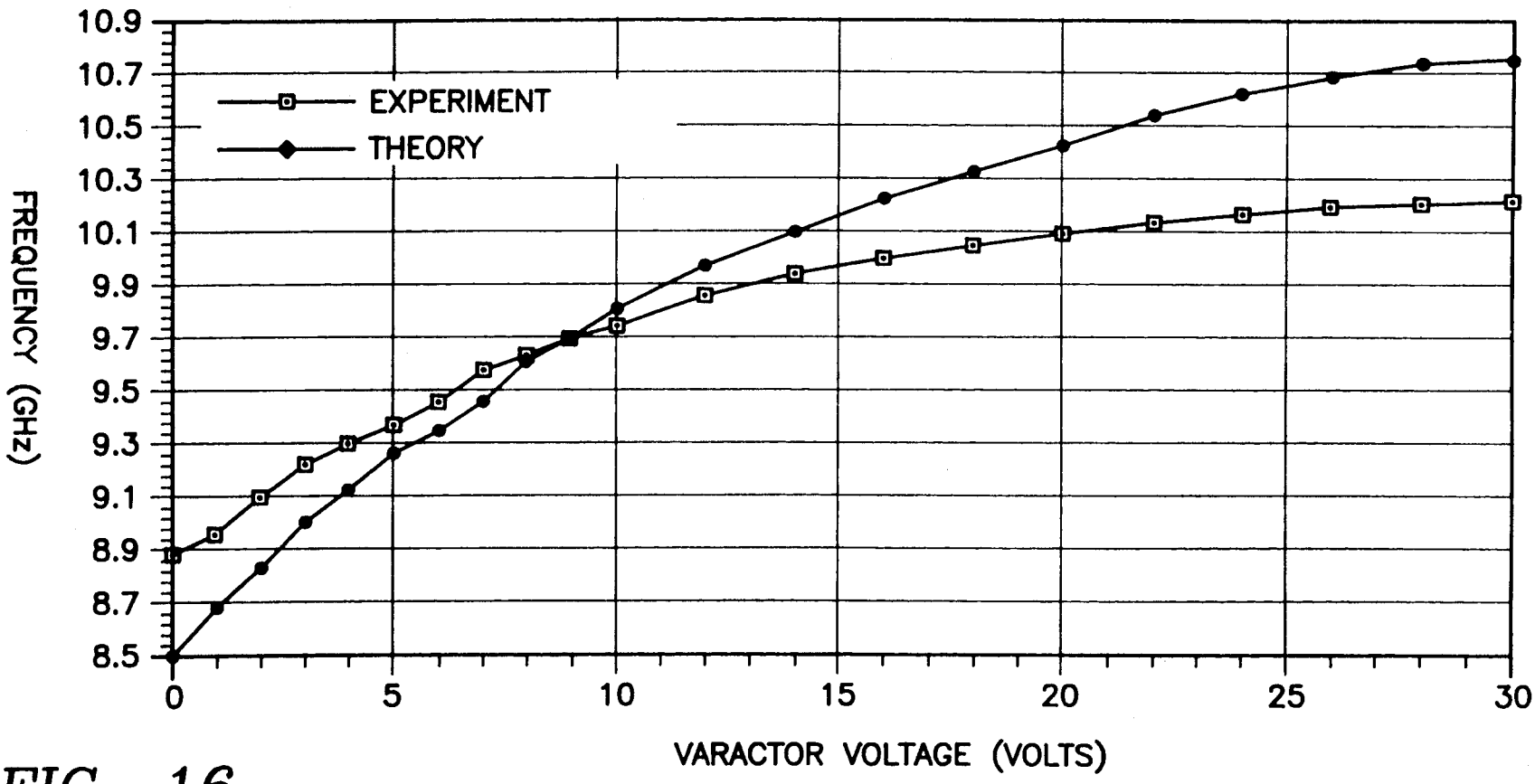
FIG. 16 is a graph of frequency as a function of varactor tuning voltage including theoretical results calculated from the transmission line model of FIG. 15 and experimental results measured from the varactor-tuned active notch antenna of FIG. 14.
Figure 17:
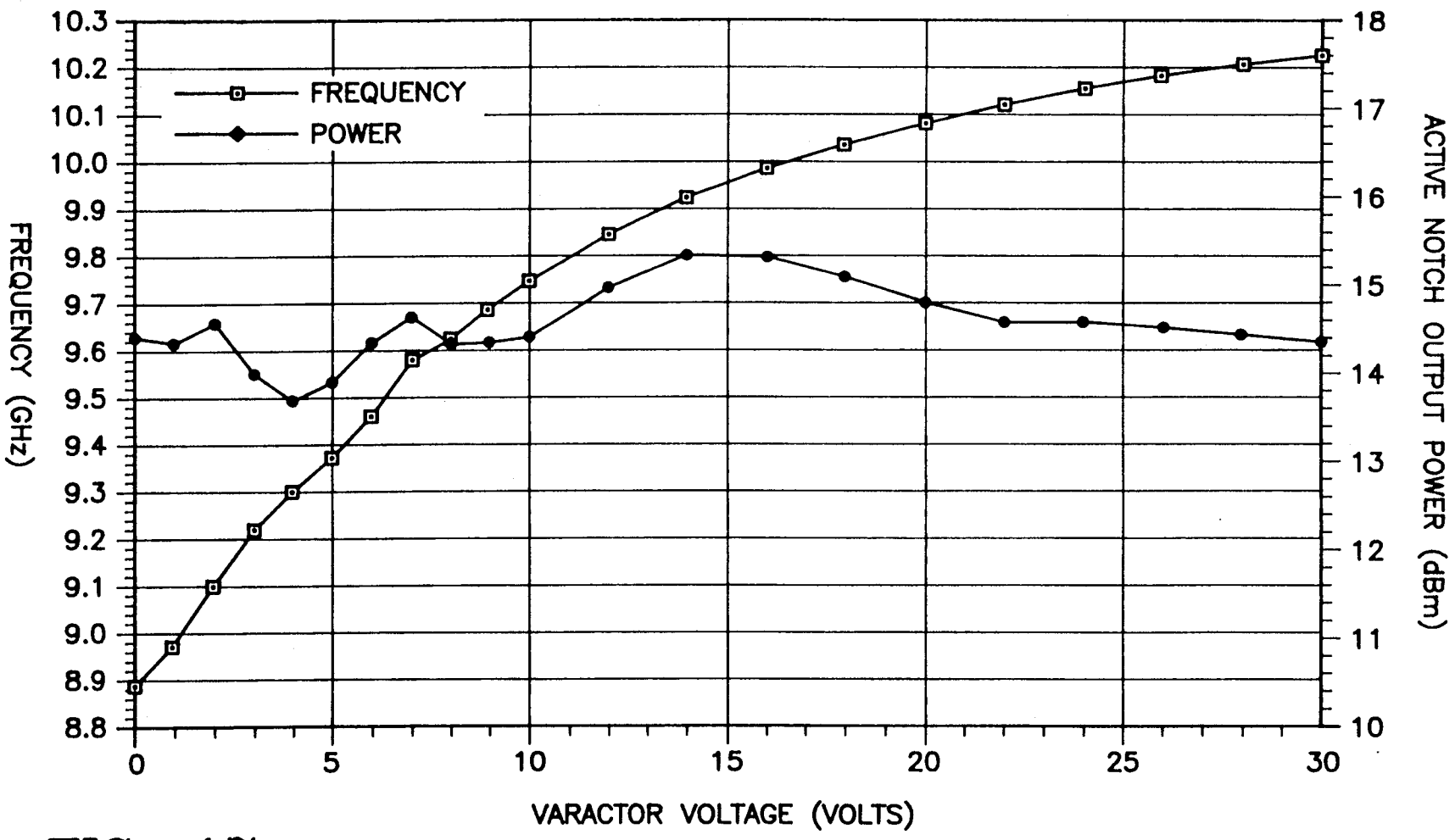
FIG. 17 is a graph of frequency and power output as a function of the varactor tuning voltage for the varactor-tuned active notch antenna of FIG. 14.

FIG. 16 shows graphs of theoretical and experimental frequency vs. varactor tuning voltage for the varactor-tuned active notch antenna configuration 80. The experimental power output and frequency vs. varactor voltage for a Gunn bias of 13.5 volts is shown in FIG. 17. The theoretical tuning curve was derived from the equivalent circuit shown in FIG. 15. The following two conditions were used to determine the frequency of the Gunn diode oscillations:

$$\mathrm{Re}(Z_{diode}) \geqq \mathrm{Re}(Z_{circuit}) \quad (1)$$

$$\mathrm{Im}(Z_{diode}) + \mathrm{Im}(Z_{circuit}) = 0 \quad (1)$$

where $Z_{diode}$ is the impedance of the Gunn diode, $Z_{circuit}$ is the impedance of the rest of the circuit seen by the Gunn diode, and $\mathrm{Re}(Z_{diode})$ is assumed to be 8 to 10 ohms. The oscillations occur when condition 1 is satisfied at the frequency specified by condition 2.

A frequency tuning range of 8.9 to 10.2 GHz was achieved for varactor voltages of 0 to 30 volts. This is equivalent to over 14% electronic tuning bandwidth. There were no mode jumps, and the signal spectrum remained clean and very stable, with an output power variation of ±0.8 dBm throughout the frequency tuning range.

Figure 18:
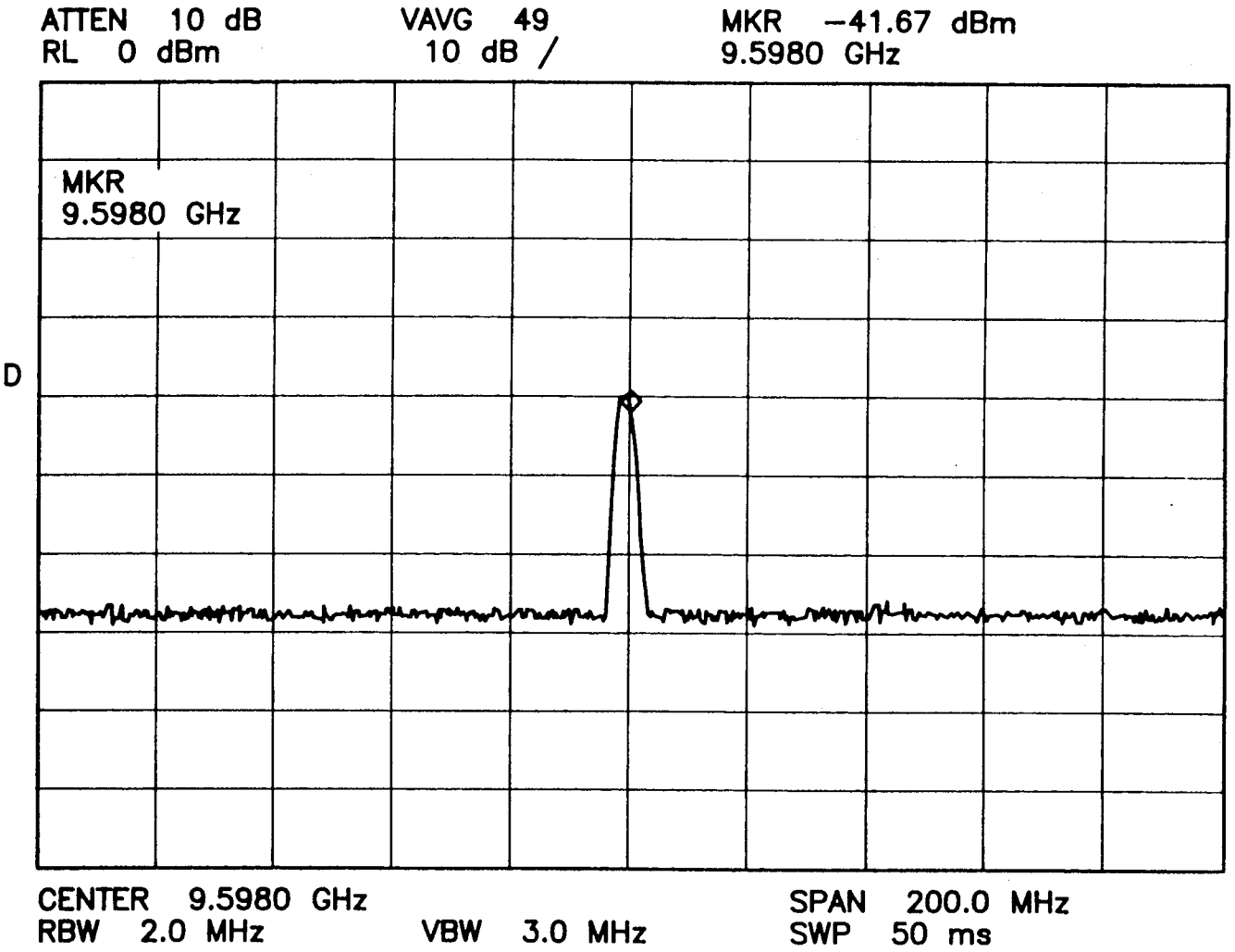
FIG. 18 is a graph of the received spectrum of the varactor-tuned active notch antenna of FIG. 14.
Figure 19:
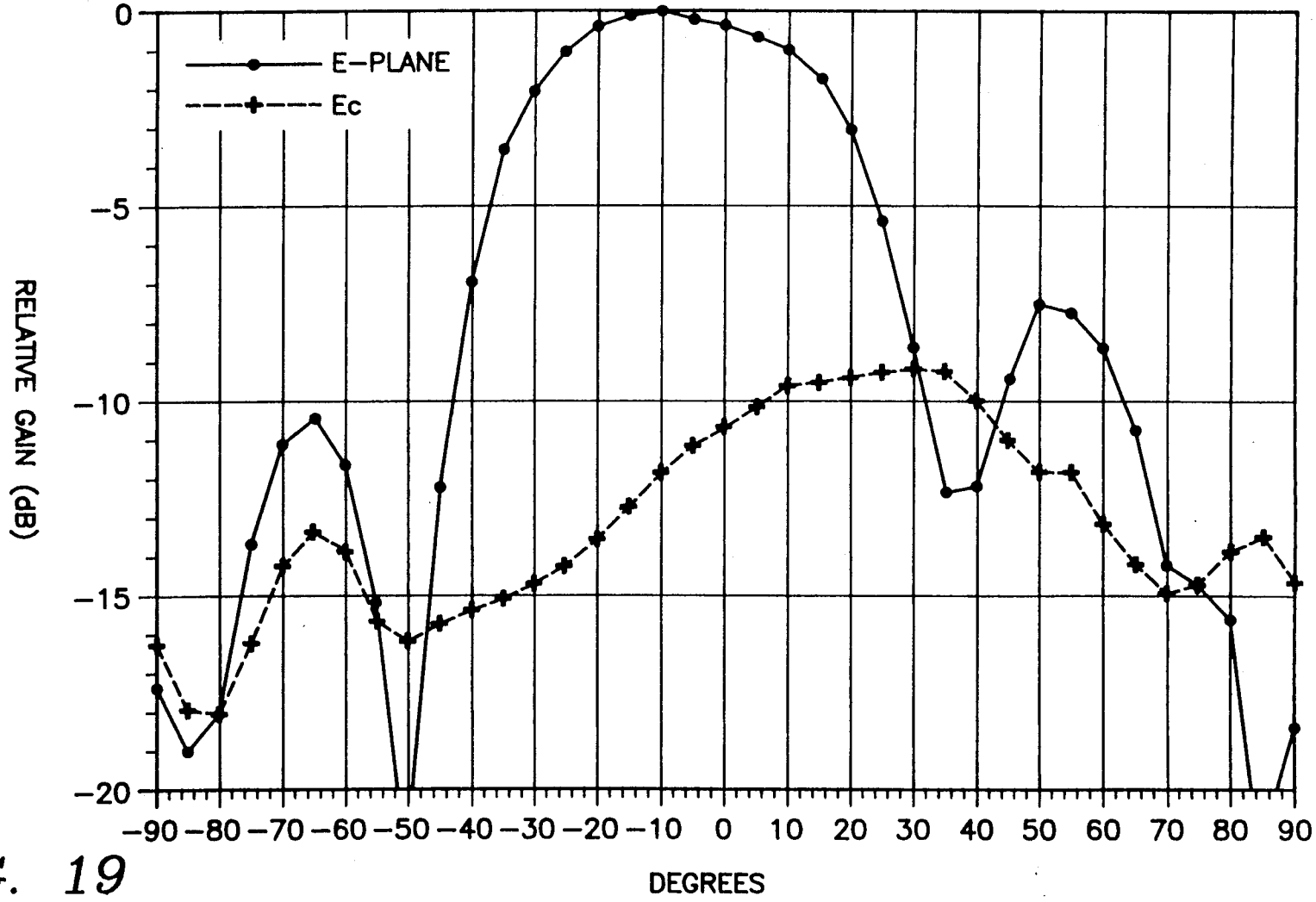
FIG. 19 is a graph of the E-plane and E-field cross-polarization patterns for the varactor-tuned active notch antenna of FIG. 14.
Figure 20:
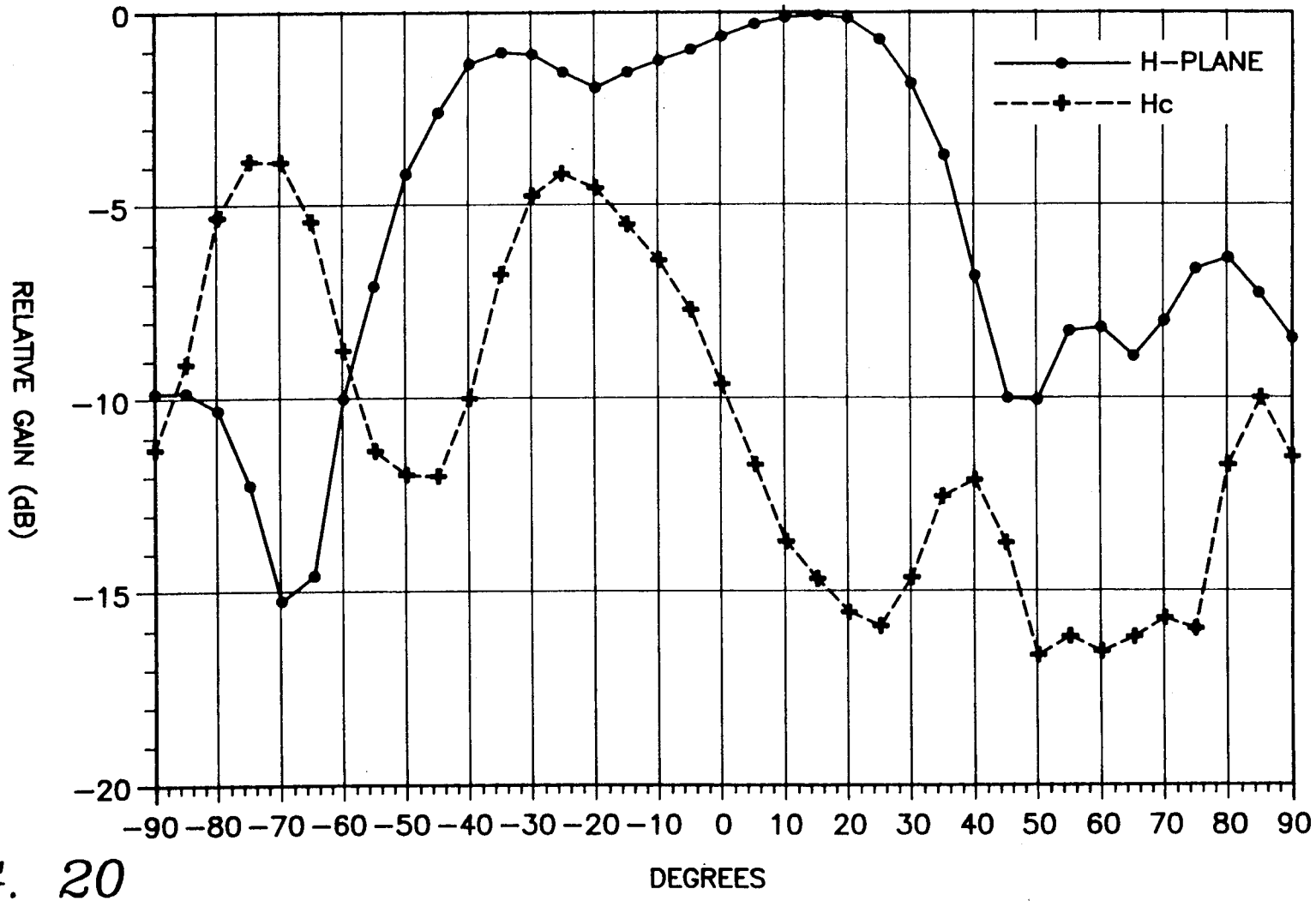
FIG. 20 is a graph of the H-plane and H-field cross-polarization patterns for the varactor-tuned active notch antenna of FIG. 14.
Figure 21:
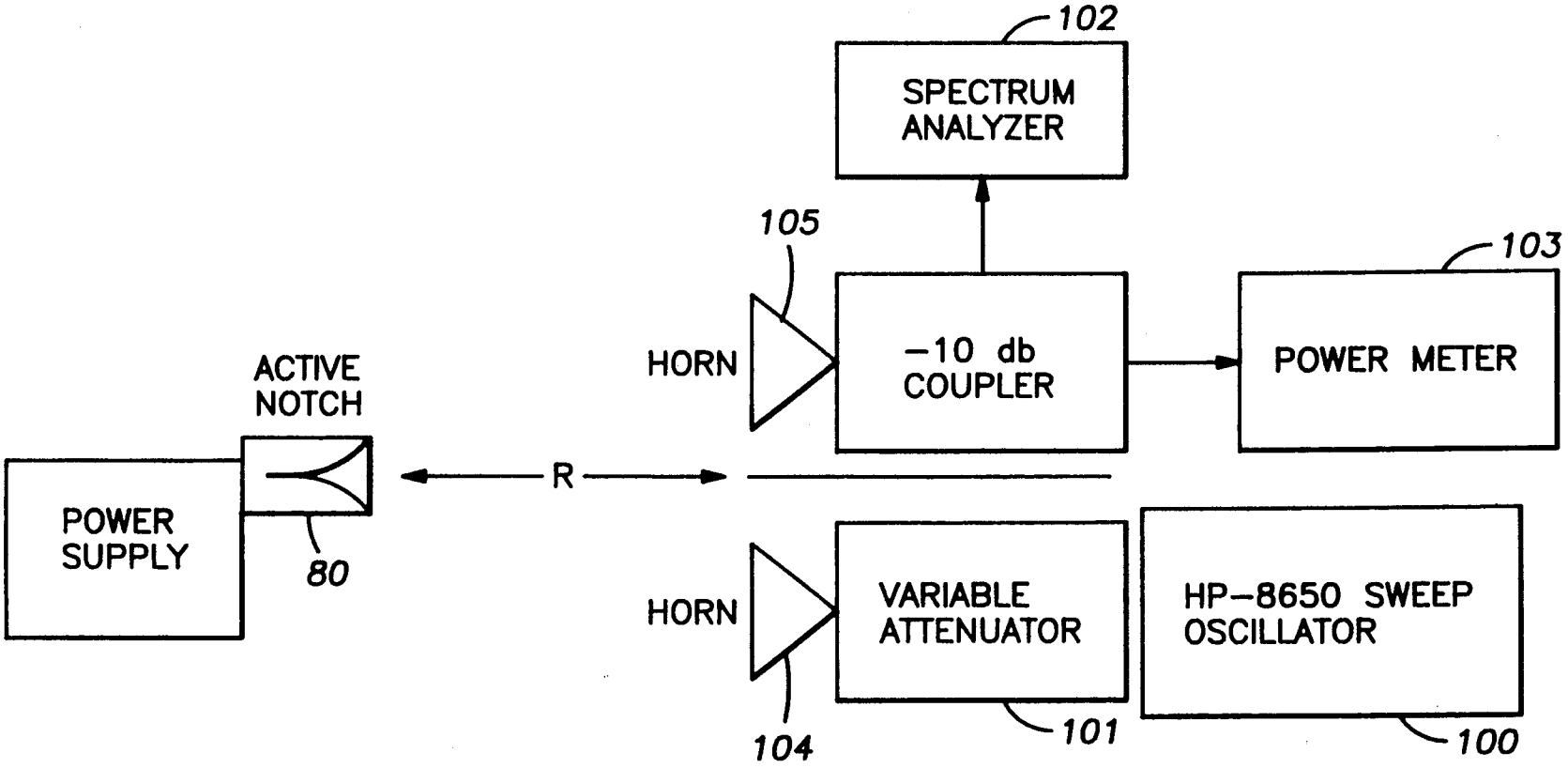
FIG. 21 is a block diagram of an arrangement for measuring the injection locking capability of the varactor-tuned active notch antenna of FIG. 14.

The spectrum of the received signal at 9.6 GHz from the varactor-tuned active notch antenna configuration 80 is shown in FIG. 18. The E and H-field patterns as well as the cross-polarization patterns are shown in FIGS. 19 and 20, respectively, for the varactor-tuned active notch antenna at 9.6 GHz. The maximum cross-polarization level is higher at the lower frequencies but diminishes to less than −15 dB at 10.2 GHz.

Injection-locking experiments with an external HP-8690B Sweep Oscillator source 100 were performed to determine the locking-gain and locking-bandwidth of the varactor-tuned active notch antenna configuration 80. The test measurement set-up is shown in FIG. 2i. The injected signal level was selected by a variable attenuator 101. The response of the antenna 80 was measured by a spectrum analyzer 102 and a power meter 103. The response was isolated from the injected signal by using separate transmitting and receiving horn antennas 104, 105 spaced a distance R from the varactor-tuned active notch antenna 80. The Friis Transmission Equation was used to determine the power delivered to the notch antenna for injection-locking.

Figure 22:
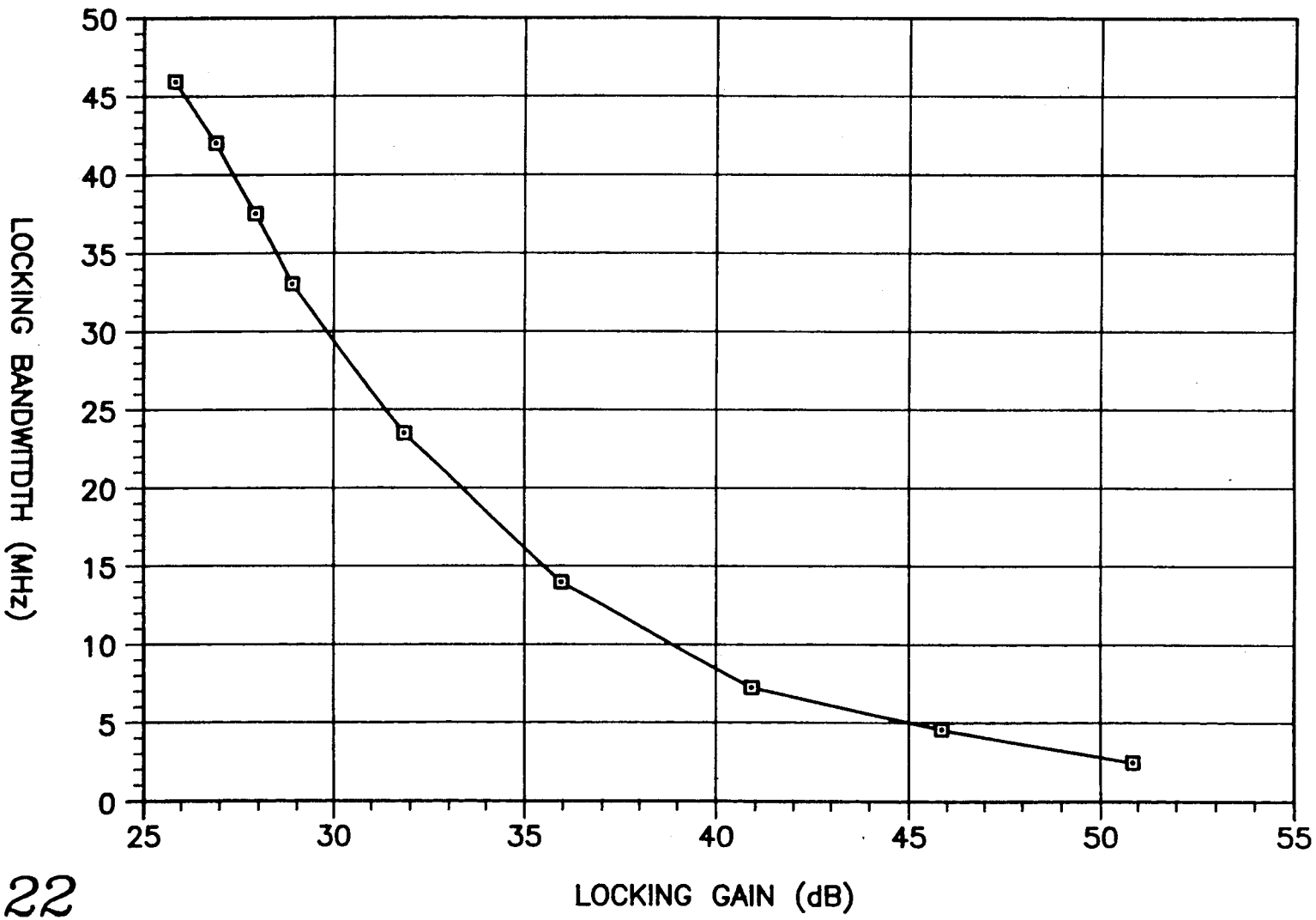
FIG. 22 is a graph of locking bandwidth versus injection-locking gain for the varactor-tuned notch antenna of FIG. 14.

The locking-gain and locking-bandwidth results are shown in FIG. 22. A locking-gain of 30 dB and a locking-bandwidth of 30 MHz were obtained at 10.2 GHz. The Q-factor of the circuit was found to be 21.5 according to:

$$Q_e = \frac{2F_o}{\Delta F}\sqrt{\frac{P_i}{P_o}} \quad (2)$$

where:

$Q_o$ = External Q-factor.

$F_o$ = Operating frequency.

$\Delta F$ = Injection-locking bandwidth.

$P_i$ = Injection-lock signal power.

$P_o$ = Free-running oscillator power.

Quasi-optical combiners using Fabry-Perot resonators and spatial power combiners have the potential of combining many solid-state devices at millimeter-wave frequencies. To demonstrate the feasibility of the spatial power combiner, two notch antennas were set up in a broadside array at 8 mm (λ/4 at 9.6 GHz) separation. To achieve efficient power-combining, the active notch antenna elements must injection-lock to each other through mutual coupling.

Power combining experiments of two injection-locked, varactor-tuned active notch antennas were conducted throughout the electronic tuning range at 100 MHz increments. For comparison, theoretical results were calculated. The power combining efficiency is defined by:

$$\text{Efficiency} = \left(\frac{P_{combiner}}{P_1 + P_2}\right)(100)\% \quad (3)$$

where:

$P_1$ = Power of active notch #1.

$P_2$ = Power of active notch #2.

$P_{combiner}$ = Power of injection-locked, power-combined signal.

The power calculations used the modified form of the Friis Transmission Equation given above. The increase in gain of the notch and the array beam sharpening were included. The power combining efficiencies measured at 9.4, 9.7, and 10 GHz were 90.0, 129.2 and 75.0%, respectively. The combining efficiency of over 100% of certain frequencies is believed to be attributed to improved impedance matching in two mutually-coupled oscillators as compared to a single oscillator.

Figure 23:
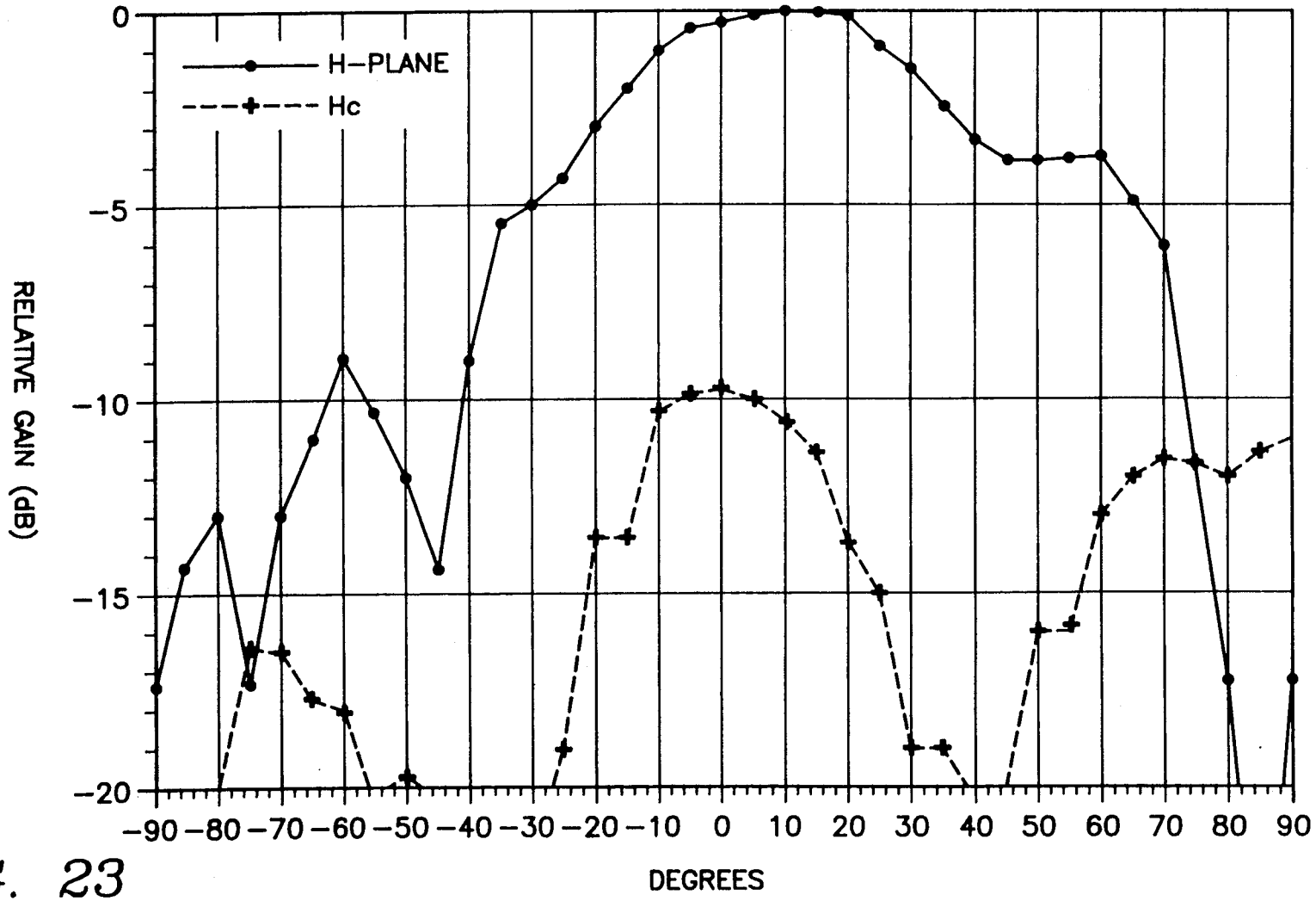
FIG. 23 is a graph of the H-plane and cross-polarization patterns for broadside power combining at 9.6 GHz and a 8 mm separation between two varactor-tuned active notch antennas of FIG. 14.

The H-plane field pattern and cross-polarization measurements at 9.6 GHz are shown in FIG. 23 for the combiner. The 3 dB beamwidth of the array was 53 degrees compared to 78 degrees for a single element.

The active notch antenna 80 of FIG. 14 offers a simple, lightweight, low-cost, small size, reproducible, and truly planar active wideband tunable source for many microwave applications. Using this element in planar arrays with injection-locking and power combining techniques will enable higher power levels. The wide varactor tuning range should prove useful for frequency modulated communication links.

Figure 24:
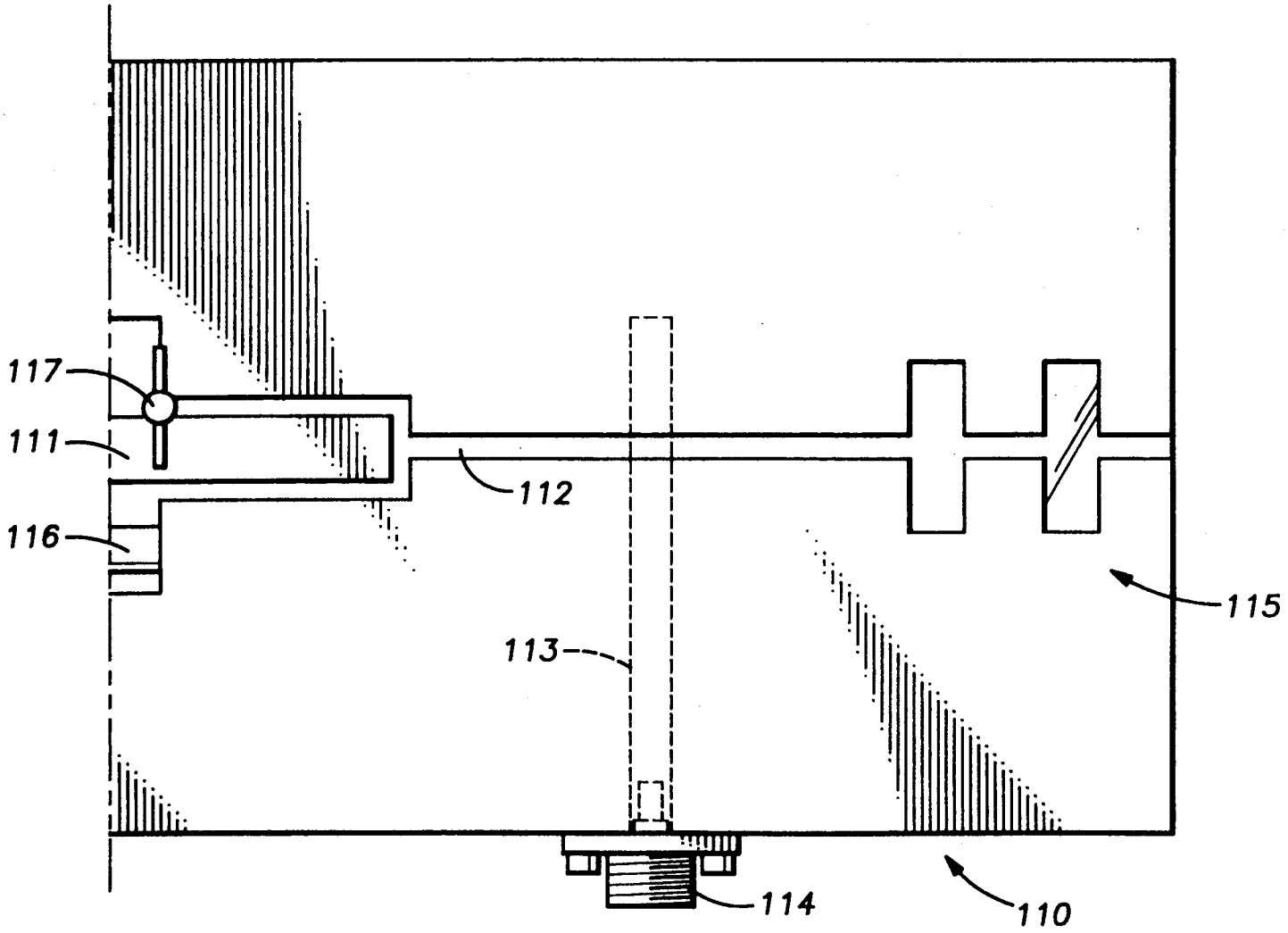
FIG. 24 is a plan view of a varactor-tuned oscillator employing a CPW resonator, a resonator-to-slotline connection, and a slotline-to-microstrip transition according to the invention.

Turning now to FIG. 24, there is shown a voltage controlled microwave oscillator 110 which further illustrates the general applicability of the present invention. The oscillator includes a CPW resonator 111 coupled to a slotline 112. The slotline, in turn, is coupled to a microstrip 113 on the bottom side of the substrate. The microstrip 113 feeds the oscillator signal to an external SMA connector 114. The slotline-to-microstrip transition also includes a low-pass filter and DC block 115 similar to the low-pass filter and DC block 52 described above in connection with FIG. 1.

Figure 25:
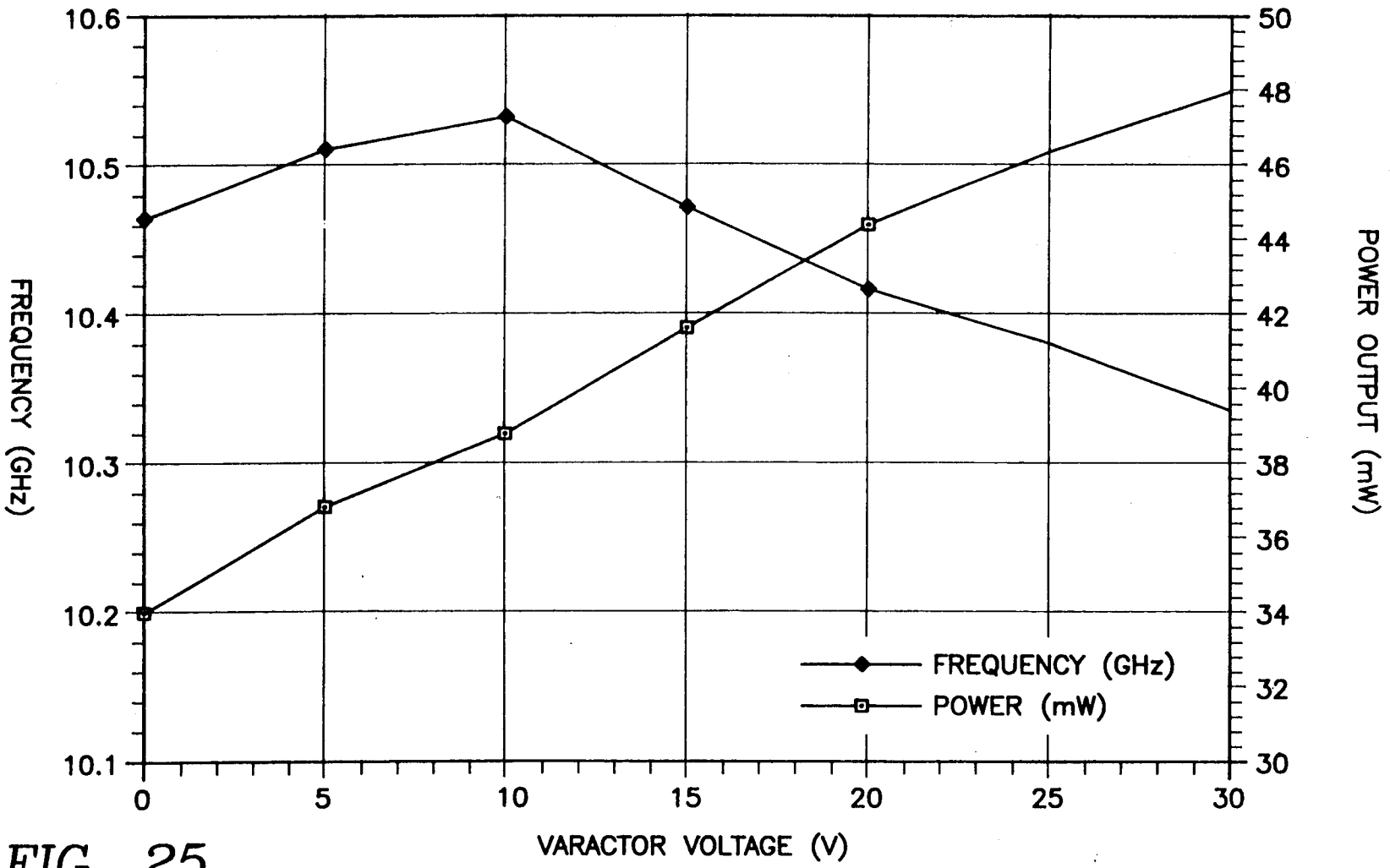
FIG. 25 is a graph of frequency and power output as a function of varactor tuning voltage for the varactor-tuned oscillator of FIG. 24.

The oscillator generates microwave power in the fashion described above in connection with FIG. 14. In particular, a Gunn diode 116 is biased for optimum generation of power and a varactor 117 is biased to adjust the frequency of oscillation. Over 40 mW was achieved with a 350 MHz tuning range as shown in FIG. 25.

Figure 26:
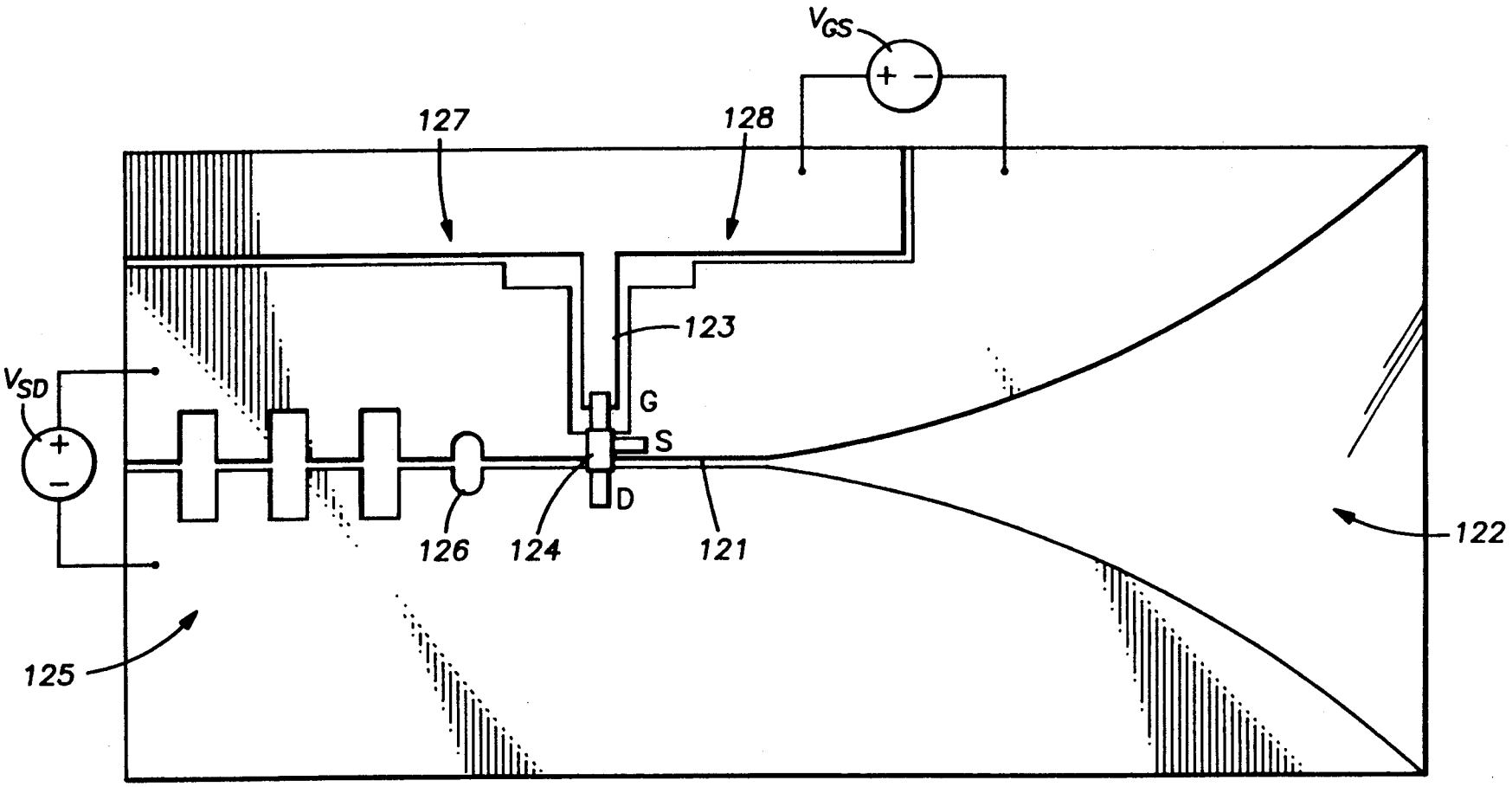
FIG. 26 is a plan view of an active notch antenna employing a field-effect transistor as the active element and interconnecting a slotline to a CPW resonator according to the invention.

Turning to FIG. 26, there is shown an active notch antenna configuration 120 that uses a slotline 121 to couple a tapered notch antenna 122 to a CPW resonator 123. In the configuration 120, however, a GaAs-FET 124 is used as an active element for microwave power generation. A GaAs-FET rather than a Gunn diode is the preferred active element for power generation in the low end of the microwave frequency range due to the higher efficiency of the GaAs-FET. Because the GaAs-FET 124 is a three-terminal device, the configuration 120 uses a low-pass filter and DC block 125 to terminate the extreme end of the slotline 121. For isolation at the frequency of oscillation, the slotline 121 is also formed with a resonant aperture 126 which open circuits the slotline 121 at the frequency of oscillation. The resonator 123 is provided with DC blocks 127 and 128 at its shorted end permitting the gate of the GaAs-FET 124 to be biased by an external voltage source $V_{Gs}$. The low-pass filter and DC block 125 permits the GaAs-FET 124 to have its source and drain biased by an independent external source $V_{SD}$.

Figure 27:
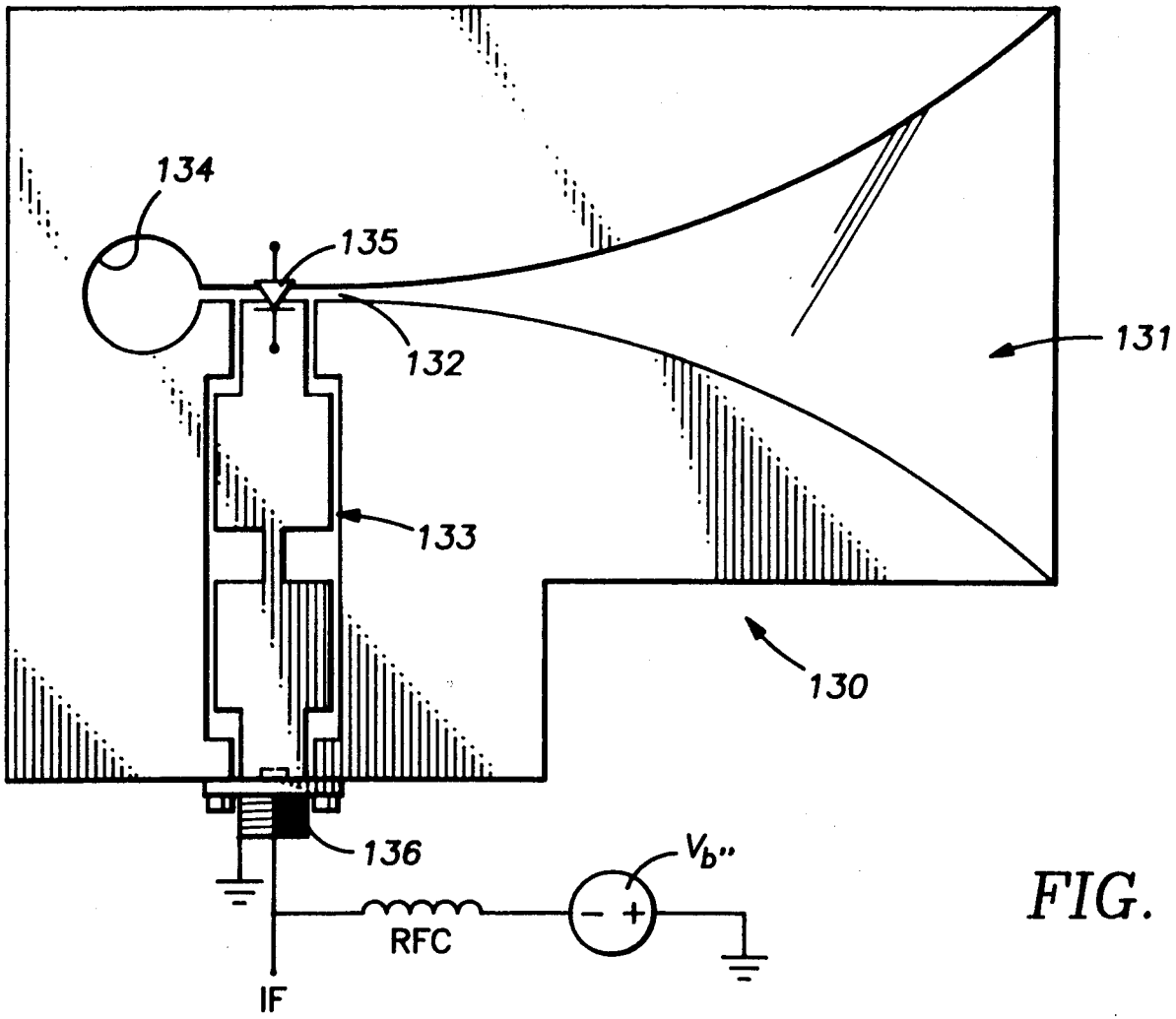
FIG. 27 is a schematic diagram of a notched antenna incorporating a mixer having a slotline connection to a CPW resonator configured as a low-pass filter according to the invention.

Turning now to FIG. 27, there is shown still another circuit which illustrates the general applicability of the present invention. In this case, a tapered notch antenna 131 is coupled by a slotline 132 to a CPW resonator 133 in a mixer configuration 130. In this case, a CPW filter 133 is configured to pass an intermediate frequency instead of the frequency of the notch antenna 131. An open circuit slotline 134 is used for impedance matching. Nonlinear mixing action is provided by a semiconductor diode !35 which is, for example, a Schottky diode. The intermediate frequency (IF) is obtained from the peripheral end of the CPW strip 133 through a SMA connector 136. The same circuits could be modified to become a detector or a subharmonic mixer.

In an alternative configuration, the diode 135 is a varactor diode for frequency multiplication. In this case, a subharmonic RF signal at one-half, one-third, or one-fourth of the antenna frequency is injected into the SMA connector 136 along with a reverse bias signal $V_b''$. The CPW filter 133 is configured to pass or resonate at the input low frequency, and the diode 135 multiplies the low frequency to the high frequency output and transmits through the notch antenna.

Figure 28:
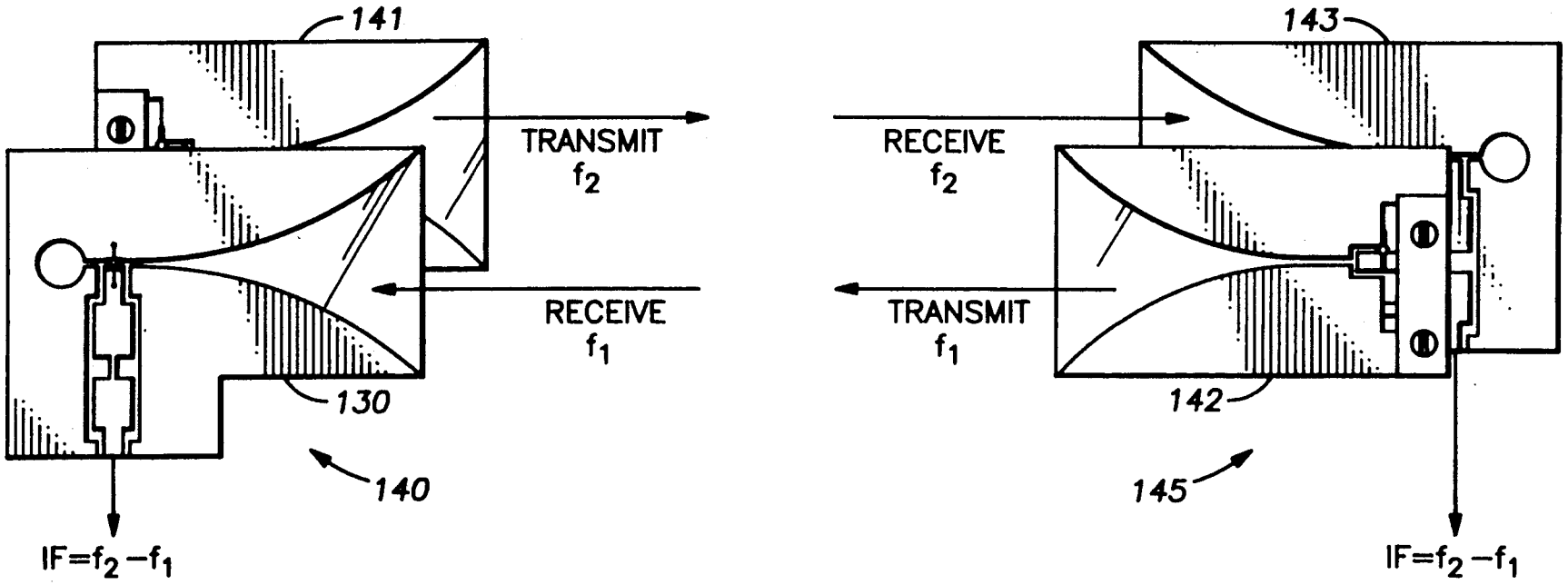
FIG. 28 is a schematic diagram of a transceiver arrangement in which local oscillator power is mutually coupled from a notch antenna transmitter to an associated notch antenna mixer.

Turning now to FIG. 28, there is shown the mixer 130 of FIG. 27 used side-by-side with an active notch antenna 141 to form a transceiver (transmitter and receiver) 140 for two-way communication systems. The notch antenna 141 is used simultaneously as with a transmitter and as a local oscillator (LO) to the mixer. The degree of local oscillator injection into the mixer is set by selecting the spacing between the mixer 130 and the active notch antenna 141. The spacing, for example, should be about a quarter to a half of a wavelength.

As shown in FIG. 28, the transceiver 140 can be used with a similar transceiver 145 having a mixer 142 and active north antenna 143 to form a communication system. The transceiver 140 receives a frequency $f_1$ and transmits a frequency $f_2$. Conversely, the transceiver 145 receives the frequency $f_2$ and transmits the frequency. The mixer 130, 142 in each of the transceivers 140, 145, however, generates the same IF frequency $f_2-f_1$.

In view of the above, there have been provided a number of CPW circuit configurations that have general applicability to microwave and millimeter-wave hybrid and monolithic circuits. Due to the true planar nature of the circuits, the circuits provide reproducible connections and electrical characteristics. The slotlines can be provided with low-pass filters, DC blocks and band-stop fibers at the antenna frequency to provide bias connections for active and passive semiconductor devices for microwave and millimeter-wave power generation, tuning, switching, frequency multiplication and mixing. In particular, the present invention provides system components such as electronically tunable and switchable bandpass filters and electronically-tuned antennas and arrays, and electronically-tuned oscillators in hybrid or monolithic circuit forms.

We claim:

1. A planar circuit formed on a planar insulating substrate, said circuit comprising, in combination:

as coplanar waveguide resonator, and a slotline extending from the periphery of the coplanar waveguide resonator, wherein said substrate has a periphery, and said slotline extends to said periphery and has a low-pass filter formed in it between said periphery and said coplanar waveguide resonator.

2. The circuit as claimed in claim 1, further comprising a microstrip transmission line coupled to said slotline at a location between said coplanar waveguide resonator and said low-pass filter.

3. The circuit as claimed in claim 2, wherein said substrate has two planar sides, said slotline is defined by at least one planar conductor on one of said sides of said substrate, and said microstrip is defined by a conductor strip on the other of said sides of said substrate.

4. A planar circuit formed on a planar insulating substrate, said circuit comprising, in combination:

a coplanar waveguide resonator, and a slotline extending from the periphery of the coplanar waveguide resonator, wherein said slotline extends to a notch antenna defined by at least one planar conductor on said substrate, said slotline extends across an end of said coplanar waveguide resonator and into an aperture resonator defining a resonant frequency for said notch antenna, and said coplanar waveguide resonator is tuned to resonate at a frequency different from said resonate frequency for said antenna.

5. The circuit as claimed in claim 4 wherein a low-pass filter is formed in said coplanar waveguide resonator.

6. A planar circuit formed on a planar insulating substrate, said circuit comprising, in combination:

a coplanar waveguide resonator, and a slotline extending from the periphery of the coplanar waveguide resonator, wherein said coplanar waveguide resonator is elongated form a closed circuit end to an open circuit end, said slotline extends generally parallel to said resonator from said open circuit end, and said coplanar waveguide resonator defines apertures about its closed circuit end on opposite sides of said resonator.

7. The circuit as claimed in claim 6, further comprising slotlines extending from said apertures defining DC blocks.

8. The circuit as claimed in claim 6, wherein a varactor is mounted on one side of said coplanar waveguide resonator, and a semiconductor device is mounted on the other side of said coplanar waveguide resonator.

9. A planar circuit formed on a planar insulating substrate, said circuit comprising, in combination:

a coplanar waveguide resonator, a slotline coupled to said coplanar waveguide resonator, and a semiconductor device connected between said coplanar waveguide resonator and a planar conductor defining said slotline, wherein said slotline provides a DC block for biasing said semiconductor device, said slotline couples a notch antenna to said coplanar waveguide resonator, and wherein said antenna is tuned to a transmission frequency and said coplanar waveguide resonator is tuned to a sub-harmonic of said transmission frequency.

10. A bandpass filter formed on a planar substrate, said bandpass filter comprising, in combination:

a plurality of coplanar waveguide resonators, a slotline extending across said substrate and interconnecting said coplanar waveguide resonators, said slotline having peripheral end portions and low-pass filters formed in the peripheral end portions, and a pair of microstrips coupled to said slotline at respective locations between said peripheral end portions and said coplanar waveguide resonators to provide input and output connections.

11. The bandpass filter as claimed in claim 10, wherein said resonators include semiconductor devices biased by a bias voltage applied across said slotline.

12. The circuit as claimed in claim 6, further comprising a coaxial connector and a microstrip line coupling said coaxial connector to said slotline.

13. The bandpass filter as claimed in claim 11, wherein said bandpass filter has a frequency response and said semiconductor devices are varactor diodes for electronic tuning of said frequency response.

14. The bandpass filter as claimed in claim 11, wherein said bandpass filter has a pass-band and said semiconductor devices are PIN diodes for switching of said pass-band between open and closed states.

15. A planar circuit formed on a planar insulating substrate, said circuit comprising, in combination:

a voltage-controlled oscillator including a coplanar waveguide resonator, and a slotline extending from the periphery of the coplanar waveguide resonator, wherein said slotline extends to a notch antenna defined by at least one planar conductor on said substrate, and wherein said coplanar waveguide resonator is elongated from a closed circuit end to an open circuit end, and said coplanar waveguide resonator defines apertures about its closed circuit end on opposite sides of said resonator.

16. The planar circuit as claimed in claim 15, further comprising slotlines extending from said apertures defining DC blocks.

17. A planar circuit formed on a planar insulating substrate, said circuit comprising, in combination:

a voltage-controlled oscillator including a coplanar waveguide resonator, and a slotline extending from the periphery of the coplanar waveguide resonator, wherein said slotline extends to a notch antenna defined by at least one planar conductor on said substrate, and wherein said voltage controlled oscillator further includes a varactor mounted on one side of said coplanar waveguide resonator, and an active semiconductor device mounted on the other side of said coplanar waveguide resonator.

18. A planar circuit formed on a planar insulating substrate, said circuit comprising, in combination:

a coplanar waveguide resonator, a slotline extending to a notch antenna defined by at least one planar conductor on sad substrate, said slotline extending near an end of said coplanar waveguide resonator, and a semiconductor device connecting said end of said coplanar waveguide resonator to said slotline, wherein said smeiconductor device is a Schottky diode.

19. A planar circuit formed on a planar insulating substrate, said circuit comprising, in combination:

a coplanar waveguide resonator, a slotline extending to a notch antenna defined by at least one planar conductor on said substrate, said slotline extending near an end of said coplanar waveguide resonator, and a semicondcutor device connecting said end of said coplanar waveguide resonator to said slotline, wherein said semiconductor device is a transistor, and wherein said slotline is defined by first and second portions of said planar conductor, sad end of said coplanar waveguide resonator and said slotline are spaced apart by said first portion of said planar conductor, and said transistor includes a first terminal connected to said first portion of said planar conductor, a second terminal connected to said second portion of said planar conductor, and a third terminal connected to said end of said coplanar waveguide resonator.

20. A planar circuit formed on a planar insulating substrate, said circuit comprising, in combination:

a coplanar waveguide resonator, a slotline extending to a notch antenna defined by at least one planar conductor on said substrate, said slotline extending near an end of said coplanar waveguide resonator, and a semiconductor device connecting said end of said coplanar waveguide resonator to said slotline, wherein said slotline extends into an aperture resonator defining a resonant frequency for said notch antenna.

21. A planar circuit formed on a planar insulating substrate, said circuit comprising, in combination:

a coplanar waveguide resonator, and a slotline extending to a notch antenna defined by at least one planar conductor on said substrate, said slotline extending across an end of said coplanar waveguide resonator, wherein said slotline extends into an aperture resonator defining a resonant frequency for said notch antenna.

22. A planar circuit formed on a planar insulating substrate, said circuit comprising, in combination:

a notch antenna defined by at least one planar conductor on said substrate, a coplanar waveguide resonator, a slotline extending to said notch antenna, and a low-pass filter formed in said slotline, said slotline extending from said low-pass filter and across an end of said coplanar waveguide resonator and into said notch antenna.

* * * * *